US010759618B2

(12) United States Patent
Iizuka

(10) Patent No.: US 10,759,618 B2
(45) Date of Patent: Sep. 1, 2020

(54) SHEET CONVEYING APPARATUS AND IMAGE FORMING APPARATUS

(71) Applicant: CANON KABUSHIKI KAISHA, Tokyo (JP)

(72) Inventor: Yoichiro Iizuka, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 169 days.

(21) Appl. No.: 15/907,704

(22) Filed: Feb. 28, 2018

(65) Prior Publication Data

US 2018/0186588 A1 Jul. 5, 2018

Related U.S. Application Data

(62) Division of application No. 15/409,681, filed on Jan. 19, 2017, now Pat. No. 9,938,102, which is a division
(Continued)

(30) Foreign Application Priority Data

Feb. 8, 2012 (JP) ..... 2012-025190

(51) Int. Cl.

| | |
|---|---|
| ***B65H 9/00*** | (2006.01) |
| ***B65H 9/20*** | (2006.01) |
| ***B65H 9/06*** | (2006.01) |
| ***B65H 5/06*** | (2006.01) |
| ***B65H 7/06*** | (2006.01) |

(Continued)

(52) U.S. Cl.
CPC ..... *B65H 9/20* (2013.01); *B65H 5/062* (2013.01); *B65H 7/06* (2013.01); *B65H 9/002* (2013.01);
(Continued)

(58) Field of Classification Search
CPC . B65H 9/00; B65H 9/004; B65H 9/06; B65H 2301/331; B65H 2404/72; B65H 2404/722; B65H 2404/725
See application file for complete search history.

(56) References Cited

U.S. PATENT DOCUMENTS

| | | | |
|---|---|---|---|
| 5,042,790 | A | 8/1991 | Miller et al. |
| 5,882,130 | A | 3/1999 | Kumazaki et al. |

(Continued)

FOREIGN PATENT DOCUMENTS

| | | | |
|---|---|---|---|
| EP | 0 782 967 | A1 | 7/1997 |
| EP | 2 399 852 | A2 | 12/2011 |
| JP | 9-183539 | A | 7/1997 |

OTHER PUBLICATIONS

International Search Report and Written Opinion of International Searching Authority issued in International Application No. PCT/JP2013/052779, dated May 10, 2013.

(Continued)

*Primary Examiner* — Thomas A Morrison
(74) *Attorney, Agent, or Firm* — Venable LLP

(57) ABSTRACT

A sheet conveying apparatus including: a locking member having an abutment surface abutting a sheet to correct skew feed of the sheet; a holding member configured to hold the locking member to rotate from a waiting position when the locking member is pushed by the sheet; a roller pair configured to nip the sheet abutting the abutment surface; a first urging portion configured to urge the holding member to the waiting position; a movable support portion configured to support the locking member in a manner that the locking member is located a retracted position where the locking member contacts a surface of the sheet and allows the sheet to pass; and a second urging portion configured to urge the locking member to a position where the abutment surface abuts a succeeding sheet.

20 Claims, 15 Drawing Sheets

Related U.S. Application Data of application No. 15/153,904, filed on May 13, 2016, now Pat. No. 9,586,778, which is a division of application No. 14/365,746, filed as application No. PCT/JP2013/052779 on Jan. 31, 2013, now Pat. No. 9,388,005.

(51) Int. Cl.
*B65H 9/14* (2006.01)

(52) U.S. Cl.
CPC ..... *B65H 9/004* (2013.01); *B65H 9/06* (2013.01); *B65H 9/14* (2013.01); *B65H 2301/331* (2013.01); *B65H 2403/531* (2013.01); *B65H 2404/725* (2013.01); *B65H 2801/06* (2013.01)

(56) References Cited

U.S. PATENT DOCUMENTS

| | | | | |
|---|---|---|---|---|
| 6,011,948 | A | 1/2000 | Amano et al. | |
| 6,394,447 | B1 | 5/2002 | Kawai et al. | |
| 7,308,227 | B2 | 12/2007 | Ahn | |
| 7,584,960 | B2 | 9/2009 | Ha | |
| 7,681,882 | B2 | 3/2010 | Yu et al. | |
| 7,720,429 | B2 | 5/2010 | Lim | |
| 7,823,879 | B2 | 11/2010 | Vargas | |
| 8,172,227 | B2 * | 5/2012 | Furusawa ..... | B65H 5/26 271/258.01 |
| 8,833,753 | B2 | 9/2014 | Araishi | |
| 8,973,918 | B2 | 3/2015 | Muramatsu et al. | |
| 9,862,559 | B2 * | 1/2018 | Suzuki ..... | B65H 7/14 |
| 2003/0215274 | A1 | 11/2003 | Ahn | |
| 2011/0089628 | A1 | 4/2011 | Watanabe et al. | |
| 2012/0093554 | A1 | 4/2012 | Suzuki | |
| 2013/0264768 | A1 | 10/2013 | Araishi | |
| 2014/0361482 | A1 | 12/2014 | Iizuka | |
| 2017/0305697 | A1 | 10/2017 | Iizuka | |

OTHER PUBLICATIONS

International Preliminary Report on Patentability issued in International Application No. PCT/JP2013/052779, dated Aug. 21, 2014.

* cited by examiner

SHEET CONVEYING APPARATUS AND IMAGE FORMING APPARATUS

This application is a Divisional Application of U.S. patent application Ser. No. 15/409,681, filed Jan. 19, 2017, which is a Divisional Application of U.S. patent application Ser. No. 15/153,904, filed May 13, 2016, now U.S. Pat. No. 9,586,778, which is a Divisional Application of U.S. patent application Ser. No. 14/365,746, filed on Jun. 16, 2014, now U.S. Pat. No. 9,388,005, which is a National Stage Entry of International Application No. PCT/JP2013/052779, filed on Jan. 31, 2013, which claims the benefit of Japanese Patent Application No. 2012-025190, filed Feb. 8, 2012, which are all hereby incorporated by reference herein in their entireties.

TECHNICAL FIELD

The present invention relates to a sheet conveying apparatus configured to correct a skew feed of a sheet being conveyed, and an image forming apparatus including the sheet conveying apparatus.

BACKGROUND ART

In general, in an image forming apparatus, accuracy of a recording position (hereinafter referred to as "recording accuracy") of an image with respect to a sheet is one of the important factors from the viewpoint of keeping the image quality. Therefore, for example, when a sheet being conveyed is skewed in an image formation, it is necessary to correct the skewed sheet to form an image in an appropriate position on the sheet. As described above, various sheet conveying apparatus having a skew feed correction function are proposed to improve the recording accuracy in the conventional image forming apparatus.

For example, the sheet conveying apparatus described in Patent Literature 1 includes a plurality of conveying roller pairs configured to convey a sheet to an image forming portion, which are arranged on an upstream side in a sheet conveying direction so as to be closest to the image forming portion (hereinafter simply referred to as "upstream side"), and a locking member rotatable about a rotary shaft for one roller of the conveying roller pairs. The locking member has an abutment surface against which the sheet abuts, and is urged by an urging spring so that the abutment surface is located at a home position (position at which a leading edge of a skewed sheet is brought into abutment with the abutment surface so that skew feed is corrected). When a leading edge of the conveyed sheet abuts against the abutment surface of the locking member, the sheet is locked by an urging force applied to the locking member, and the locked sheet is deflected to be curved to form a loop. The loop thus formed causes the leading edge portion of the sheet to be aligned with a width direction orthogonal to the sheet conveying direction, to thereby correct the skew feed. After that, when the locking member is pushed and rotated by stiffness of the sheet, the sheet is nipped by nips of the conveying roller pairs with the leading edge of the sheet being aligned in the width direction, and conveyed to a downstream side by the conveying roller pairs.

By the way, in recent years, much higher throughput (number of sheets subjected to image formation per unit time) of an image forming apparatus has been demanded. In order to meet this demand, it has been required to convey sheets at a higher speed, and reduce a distance between a trailing edge of a preceding sheet and a leading edge of a succeeding sheet (hereinafter referred to as "sheet-to-sheet distance"). In accordance therewith, it is necessary to return the locking member to its home position within a short sheet-to-sheet distance.

In this context, FIGS. 23A and 23B illustrate a locking member 170 provided in a conventional sheet conveying apparatus. As illustrated in FIGS. 23A and 23B, the conventional locking member 170 is supported in a manner of being reciprocally rotatable about a rotary shaft 131*a* of a conveying roller 131, which forms a nip N with a conveying rotatable member 132. After correcting skew feed of a sheet S by bringing a leading edge of the sheet S into abutment against an abutment surface 170*a* at a home position HP, the locking member 170 is rotated to guide the sheet S to the nip N. Then, after the sheet S passes through the nip N, the locking member 170 is reversely rotated to return to the home position HP.

In this case, a requisite minimum sheet-to-sheet distance is equal to a total distance of a distance D1 from a position at which a trailing edge of a preceding sheet S passes the abutment surface 170*a* of the locking member 170 to the home position HP at which the skew feed of the sheet S is corrected, and a distance D2 required for conveying a succeeding sheet S to the home position HP while the preceding sheet S is moved by the distance D1. The locking member 170 performs reciprocating rotation, and hence the distance D1 is generated so as to return the locking member 170 to the home position HP after the sheet S passes through the nip N, and the locking member 170 takes a time $\Delta T$ for moving the distance D1. On the other hand, the distance D2 is a distance ($\Delta T \times V$) obtained by multiplying the time $\Delta T$ during which the locking member 170 moves the distance D1 by a conveying speed V of the sheet S. As the conveying speed V of the sheet S becomes higher, the distance becomes longer. Therefore, in the conventional sheet conveying apparatus, when the conveying speed V of the sheet S is increased, the sheet-to-sheet distance needs to be set longer, and hence further enhancement of the throughput is practically impossible.

Thus, in the sheet conveying apparatus in which skew feed of sheets is corrected by using the locking member, enhancement of throughput of the sheet conveyance has been limited due to a time period for returning the locking member.

CITATION LIST

Patent Literature

PTL 1: Japanese Patent Application Laid-Open No. H09-183539

SUMMARY OF INVENTION

In view of the circumstances, the present invention provides a sheet conveying apparatus configured to enhance throughput, and an image forming apparatus including the sheet conveying apparatus.

According to the present invention, there is provided a sheet conveying apparatus, including: a sheet conveying path through which a sheet is conveyed; a locking member having an abutment surface against which a leading edge of the sheet conveyed through the sheet conveying path abuts so that a skew feed of the sheet is corrected; a holding member configured to hold the locking member, the holding member being rotated integrally with the locking member from a waiting position when the locking member is pushed by the leading edge of the sheet being conveyed; a roller pair configured to nip the sheet of which the leading edge is in abutment against the abutment surface of the locking member; a first urging portion configured to urge the holding member so as to move the holding member to the waiting position after the sheet is nipped between the roller pair; a movable support portion configured to support the locking member in a manner that the locking member is movable with respect to the holding member so that the locking member is located in a retracted position in which the locking member is brought into contact with a surface of the sheet being conveyed by the roller pair and allows the sheet to pass in a state in which the holding member is located in the waiting position; and a second urging portion configured to urge the locking member in a manner that the locking member is moved from the retracted position to a position in which the abutment surface abuts against a leading edge of a succeeding sheet as a trailing edge of the sheet being conveyed by the roller pair passes the locking member.

According to the present invention, the throughput can be enhanced.

Further features of the present invention will become apparent from the following description of exemplary embodiments with reference to the attached drawings.

DESCRIPTION OF EMBODIMENTS

In the following, an image forming apparatus according to an embodiment of the present invention will be described with reference to the drawings. The image forming apparatus according to the embodiment is an image forming apparatus, such as a copier, a printer, a facsimile machine, and a multifunction peripheral combining those machines, including a sheet conveying portion serving as a sheet conveying apparatus, which includes a skew feed correcting portion configured to correct a skew feed of a sheet being conveyed. In the following embodiments, the image forming apparatus will be described, taking an electrophotographic color image forming apparatus (hereinafter simply referred to as "image forming apparatus") 1 configured to form toner images of four colors as an example.

First Embodiment

Figure 1:
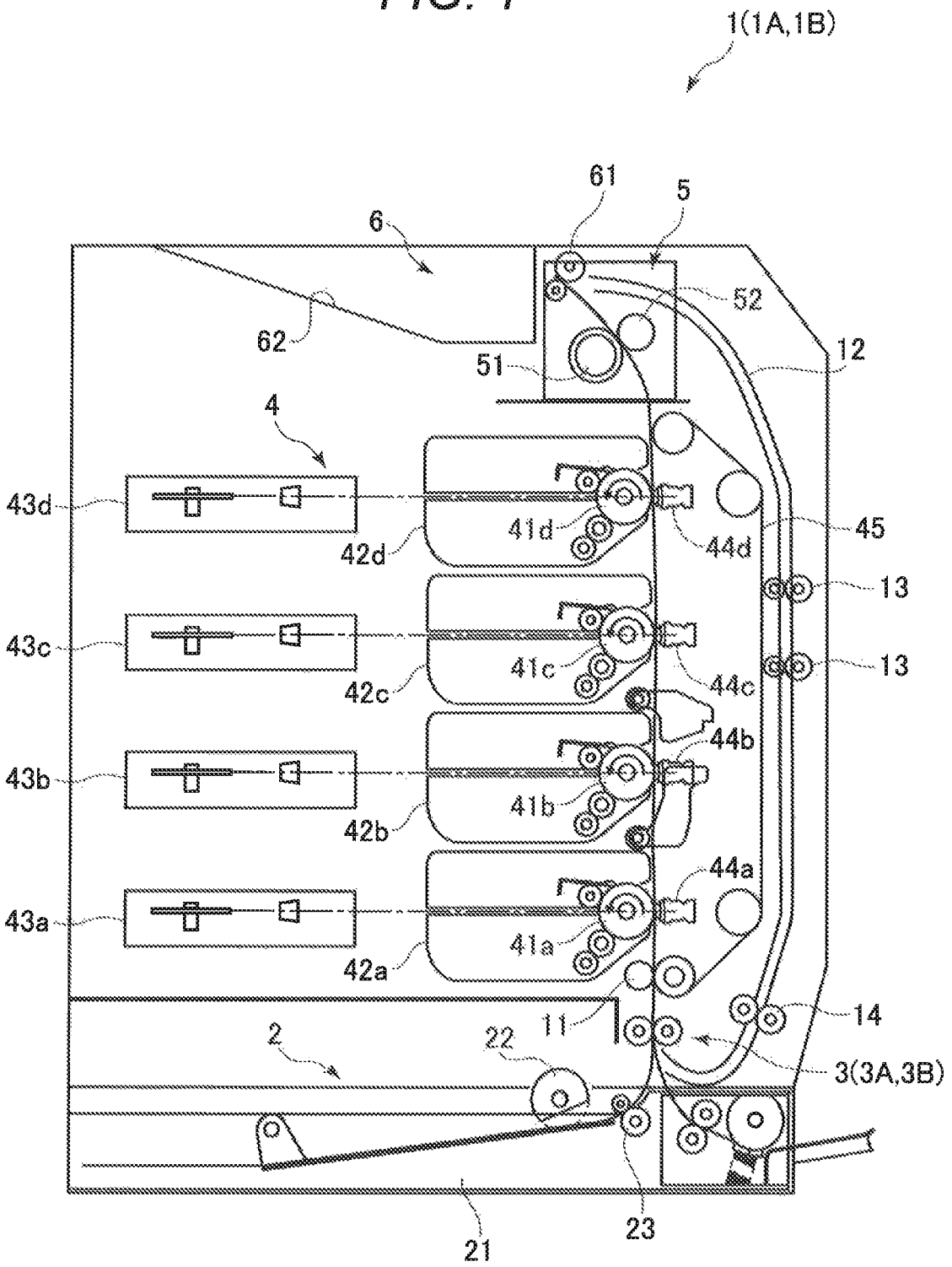
FIG. 1 is a schematic sectional view of an overall structure of an image forming apparatus according to an embodiment of the present invention.

The image forming apparatus 1 according to a first embodiment of the present invention will be described with reference to FIGS. 1 to 13. First, an overall structure of the image forming apparatus 1 according to the first embodiment will be described with reference to FIG. 1. FIG. 1 is a schematic sectional view of the overall structure of the image forming apparatus 1 according to the embodiment of the present invention.

As illustrated in FIG. 1, the image forming apparatus 1 according to the first embodiment includes a sheet feeding portion 2 configured to feed a sheet S, a sheet conveying portion 3 configured to convey the sheet S while correcting skew feed of the sheet S, and an image forming portion 4 configured to form an image on the sheet S conveyed from the sheet conveying portion 3. Further, the image forming apparatus 1 includes a fixing portion 5 configured to fix an unfixed image, which is formed by the image forming portion 4, onto the sheet S, and a delivery portion 6 configured to deliver the sheet S on which the image is fixed.

The sheet feeding portion 2 is arranged in a lower portion of the image forming apparatus 1, and includes a detachably mountable sheet containing portion 21 configured to contain the sheets S and a pick-up roller 22 configured to send the sheets S contained in the sheet containing portion 21. The sheet feeding portion 2 includes a separating portion 23 configured to separate one by one the sheets S sent by the pick-up roller 22. The sheet conveying portion 3 is arranged on a downstream side of the sheet feeding portion 2 in a sheet feeding direction (hereinafter simply referred to as "downstream side"), and includes a skew feed correcting portion 7 configured to correct a skew feed of the sheet S. Note that, the sheet conveying portion 3 will be described in detail later.

The image forming portion 4 is arranged on the downstream side with respect to the sheet conveying portion 3, and includes photosensitive drums 41*a*, 41*b*, 41*c*, and 41*d* on which toner images of yellow, magenta, cyan, and black are respectively formed, and exposure devices 43*a*, 43*b*, 43*c*, and 43*d* configured to form electrostatic latent images respectively on surfaces of the photosensitive drums 41*a* to 41*d*. Further, the image forming portion 4 includes process cartridges 42*a*, 42*b*, 42*c*, and 42*d* configured to respectively develop the electrostatic latent images formed by the exposure devices 43*a* to 43*d* into toner images, transfer portions 44*a*, 44*b*, 44*c*, and 44*d* configured to respectively transfer the toner images onto the sheet S, and a transfer belt 45 configured to convey the sheet S. The photosensitive drums 41*a* to 41*d* are arranged to be rotatable by motors (not shown). The process cartridges 42*a* to 42*d* each is made into a unit integrally including a charger, a developing device, and a cleaner, which are arranged around a corresponding one of the photosensitive drums 41*a* to 41*d*. The transfer portions 44*a* to 44*d* are arranged on an inside of the transfer belt 45 while opposing to the photosensitive drums 41*a* to 41*d*, respectively. The transfer belt 45 is arranged so that the rotation of the transfer belt 45 moves the sheets S sequentially to the transfer portions 44*a* to 44*d*.

The fixing portion 5 is arranged downstream of the image forming portion 4, and includes a fixing roller 51 provided with a built-in heater and a pressure roller 52 which is pressed against the fixing roller 51. The delivery portion 6 is arranged downstream of the fixing portion 5, and includes a delivery roller pair 61 configured to deliver the sheets S to an outside of the image forming apparatus, and a delivery tray 62 configured to stack the sheets S delivered to the outside of the image forming apparatus.

Next, an image forming process of the image forming apparatus 1 according to the first embodiment structured as described above will be described. When an image forming operation is started, based on image information input from a personal computer (not shown), first, the exposure device 43*a* emits a laser beam according to an image signal of a yellow color component of an original to the photosensitive drum 41*a* uniformly charged by the charger of the process cartridge 42*a*. In this way, a yellow electrostatic latent image is formed on the photosensitive drum 41*a*. Next, the yellow electrostatic latent image is developed with a yellow toner contained in the developing device of the process cartridge 42*a*. In this way, the yellow electrostatic latent image is visualized as a yellow toner image. In the same manner as described above, the electrostatic latent images of magenta, cyan, and black are formed respectively on the surfaces of the photosensitive drums 41*b* to 41*d*, and those electrostatic latent images are visualized respectively as a magenta toner image, a cyan toner image, and a black toner image.

Along with the above-mentioned toner image forming operation, the sheets S contained in the sheet containing portion 21 are sent to the sheet conveying portion 3 located on the downstream side while being separated one by one by the pick-up roller 22 and the separating portion 23. The sheet S sent to the sheet conveying portion 3 is subjected to skew feed correction by the skew feed correcting portion 7 in the sheet conveying portion 3, and then conveyed to the transfer portion 44*a* of the image forming portion 4 at a predetermined timing by a registration roller pair 11 located downstream of to the sheet conveying portion 3.

When the sheet S is conveyed to the transfer portion 44*a*, the yellow toner image formed on the surface of the photosensitive drum 41*a* is transferred onto the sheet S by transfer bias applied to a transfer charger (not shown). After the yellow toner image is transferred onto the sheet S, the magenta toner image, the cyan toner image, and the black toner image are sequentially transferred in a superimposed manner onto the yellow toner image while the sheet S is conveyed by the transfer belt 45 in the same manner as described above. In this way, a full-color toner image is formed on the sheet S.

The sheet S on which the full-color toner image is transferred is conveyed to the fixing portion 5, and the toners are fused and mixed while being heated and pressurized by the fixing roller 51 and the pressure roller 52. In this way, the full-color toner image is fixed as a full-color image. After that, the sheet S on which the full-color image is fixed is delivered by the delivery roller pair 61 provided downstream of the fixing portion 5 onto the delivery tray 62 arranged in an upper portion of the image forming apparatus 1. With this, the image forming process is completed.

Note that, duplex printing is performed as follows. After an image is fixed to a first side of the sheet S in the fixing portion 5, the delivery roller pair 61 is reversely rotated so that the sheet S is not delivered onto the delivery tray 62 by the delivery roller pair 61 but conveyed into a duplex conveying path 12 with the front side and the back side of the sheet S being reversed. The sheet S conveyed into the duplex conveying path 12 is re-conveyed to the sheet conveying portion 3 by oblique-feed roller pairs 13 and a U-turn roller pair 14 so that the sheet S is subjected to the skew feed correction at the skew feed correcting portion 7 of the sheet conveying portion 3. Then, the sheet S is conveyed to the image forming portion 4 so that an image is fixed to a second side of the sheet S by the image forming portion 4.

Figure 2A:
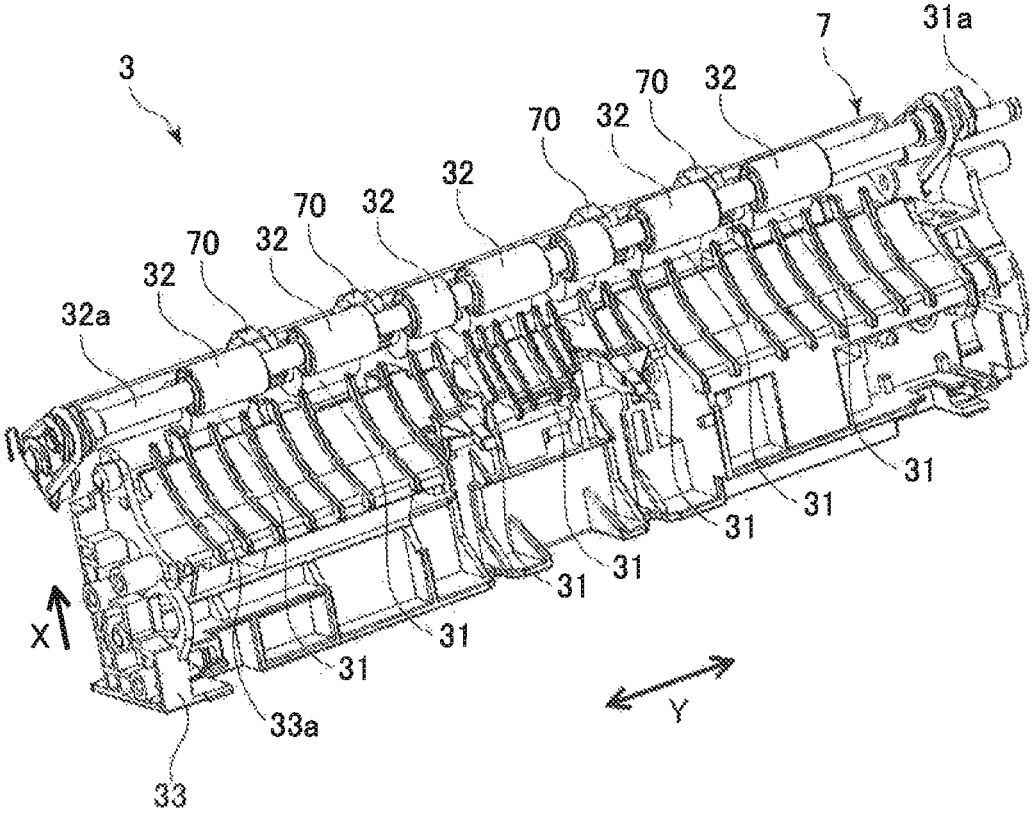
FIG. 2A is a perspective view of a sheet conveying portion according to a first embodiment.
Figure 2B:
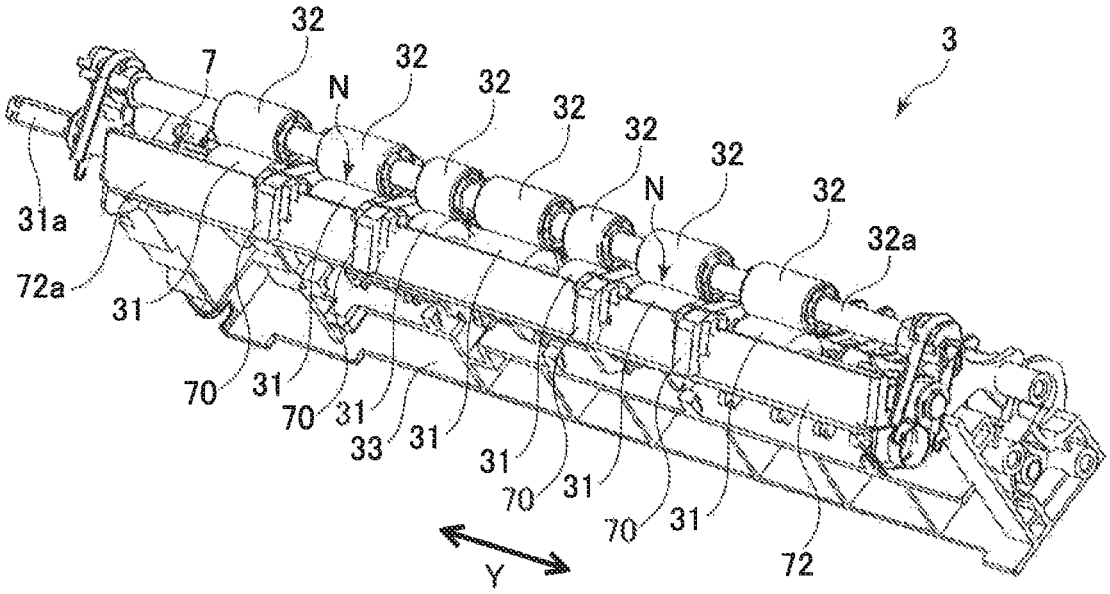
FIG. 2B is a perspective view of the sheet conveying portion illustrated in FIG. 2A as viewed from the opposite side.
Figure 3:
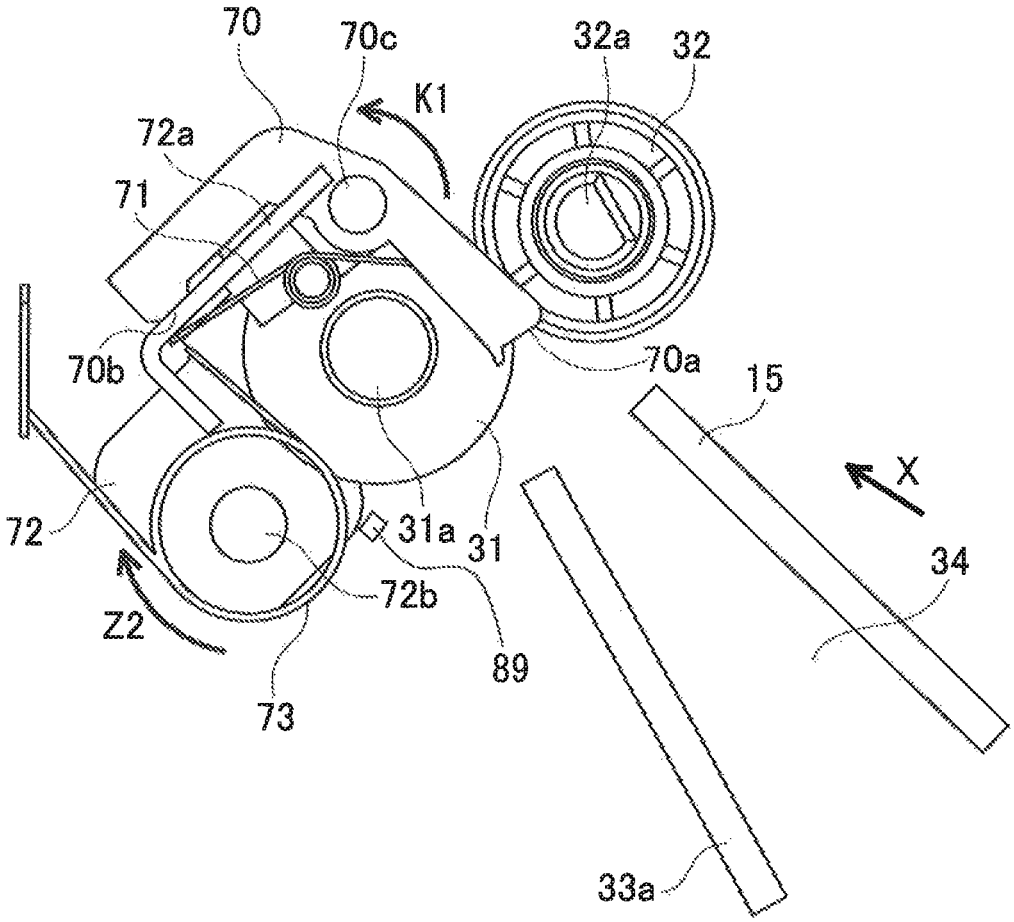
FIG. 3 is a schematic sectional view of the sheet conveying portion according to the first embodiment.

Next, the sheet conveying portion 3 of the image forming apparatus 1 according to the first embodiment will be described with reference to FIGS. 2A to 13 in addition to FIG. 1. First, an overall structure of the sheet conveying portion 3 will be described with reference to FIGS. 2A, 2B, and 3. FIG. 2A is a perspective view of the sheet conveying portion 3 according to the first embodiment. FIG. 2B is a perspective view of the sheet conveying portion 3 illustrated in FIG. 2A as viewed from the opposite side. FIG. 3 is a schematic sectional view of the sheet conveying portion 3 according to the first embodiment.

As illustrated in FIGS. 2A, 2B, and 3, the sheet conveying portion 3 includes a plurality of conveying rollers 31 as a sheet conveying unit, a plurality of conveying rotatable members 32 as a sheet conveying unit, a feeding frame 33, and the skew feed correcting portion 7. The plurality of conveying rollers 31 are firmly fixed to a roller shaft 31*a*, and the roller shaft 31*a* is rotatably supported by the feeding frame 33 in parallel to a sheet width direction Y orthogonal to a sheet conveying direction X. The plurality of conveying rotatable members 32 are supported by a rotatable member shaft 32*a* to be rotatable about the rotatable member shaft 32*a* so as to respectively oppose to the plurality of conveying rollers 31. The rotatable member shaft 32*a* is supported by the feeding frame 33 in parallel to the roller shaft 31*a* so that the plurality of conveying rotatable members 32 and the plurality of conveying rollers 31 form respective nips N. Note that, the sheet width direction Y is parallel to a direction of a rotary shaft of each of the photosensitive drums 41*a* to 41*d*.

The feeding frame 33 includes a guide portion 33*a* configured to guide the sheet S together with a guide frame 15 to the nips N, the guide portion 33*a* being provided upstream of the nips N formed by the plurality of conveying rotatable members 32 and the plurality of conveying rollers 31. In cooperation with the guide frame 15, the guide portion 33*a* regulates both sides in a thickness direction of the sheet S on the upstream side of the nips N, and guides the sheet S to the nips N. Further, the guide portion 33*a* and the guide frame 15 form a loop forming portion 34 in which the sheet S is curved by abutting against abutment surfaces 70*a* of locking members 70 described below so as to form a loop. Skew feed of the sheet S conveyed to the sheet conveying portion 3 is corrected through formation of the loop in the loop forming portion 34. Note that, in this embodiment, although the guide frame 15 configured to guide the sheet S to the nips N together with the guide portion 33*a* is additionally provided, a guide portion configured to guide the sheet S to the nips N together with the guide portion 33*a* may be provided on the feeding frame 33.

The skew feed correcting portion 7 includes a holding member 72 supported by to the feeding frame 33 so as to be rotatable, a first urging spring 73 as a first urging portion configured to urge the holding member 72, and the plurality of locking members 70 supported by the holding member 72 so as to be rotatable. Further, the skew feed correcting portion 7 includes a plurality of second urging springs 71 as second urging portions configured to respectively urge the plurality of locking members 70.

The holding member 72 is supported by the feeding frame 33 so as to be rotatable, about a rotary shaft 72*b* parallel to the roller shaft 31*a*, between a first position illustrated in FIG. 3 and a second position illustrated in FIG. 8 as described below. The holding member 72 is urged by the first urging spring 73 in a direction indicated by an arrow Z2 in FIG. 3 so that the holding member 72 is located in the first position. In other words, a stopper 89 regulates the holding member 72 from being rotated in the direction indicated by the arrow Z2 by the first urging spring 73. Further, the holding member 72 includes a regulating portion 72*a* configured to regulate rotation of the plurality of locking members 70, and the regulating portion 72*a* is provided on a rear surface side of the holding member (downstream side in the sheet conveying direction).

The locking member 70 is formed into a substantially L-shape, and includes the abutment surface 70*a* configured to abut against a downstream leading edge (hereinafter simply referred to as "leading edge") of the sheet S on the sheet conveying path, a striking surface 70*b* configured to strike against the regulating portion 72*a*, and a rotary shaft 70*c* parallel to the rotary shaft 72*b*. The locking member 70 has one end provided with the abutment surface 70*a* and the other end provided with the striking surface 70*b*. The locking member 70 is held by the holding member 72 so as to be movable (rotatable) so that the abutment surface 70*a* and the striking surface 70*b* are rotated about the rotary shaft 70*c*. A movable support portion provided on the holding member 72 rotatably supports the rotary shaft 70*c*, and hence the locking member 70 is movably held by the holding member 72. The holding member 72 and the locking member 70 are movable (rotatable) integrally with each other. When the holding member 72 is located in the first position, the locking member 70 is movable to a protruding position in which the abutment surface 70*a* protrudes on the sheet conveying path upstream of the nip N and to a retracted position in which the abutment surface 70*a* is retracted toward the holding member 72. The striking surface 70*b* strikes against the regulating portion 72*a* so as to regulate the rotation of the locking member 70 urged by the second urging spring 71 toward the protruding position (in the direction indicated by the arrow K1 in FIG. 3). In this way, the locking member 70 is maintained in the protruding position.

Figure 4:
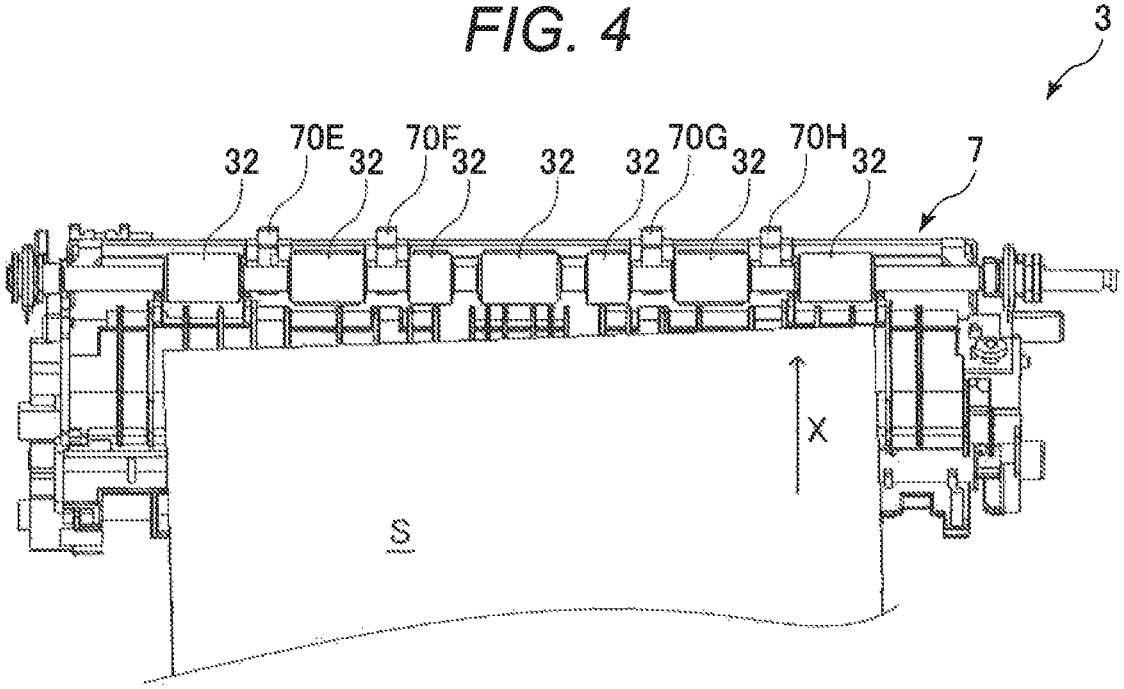
FIG. 4 is a plan view illustrating a state in which a sheet enters the sheet conveying portion in a skewed state.
Figure 5:
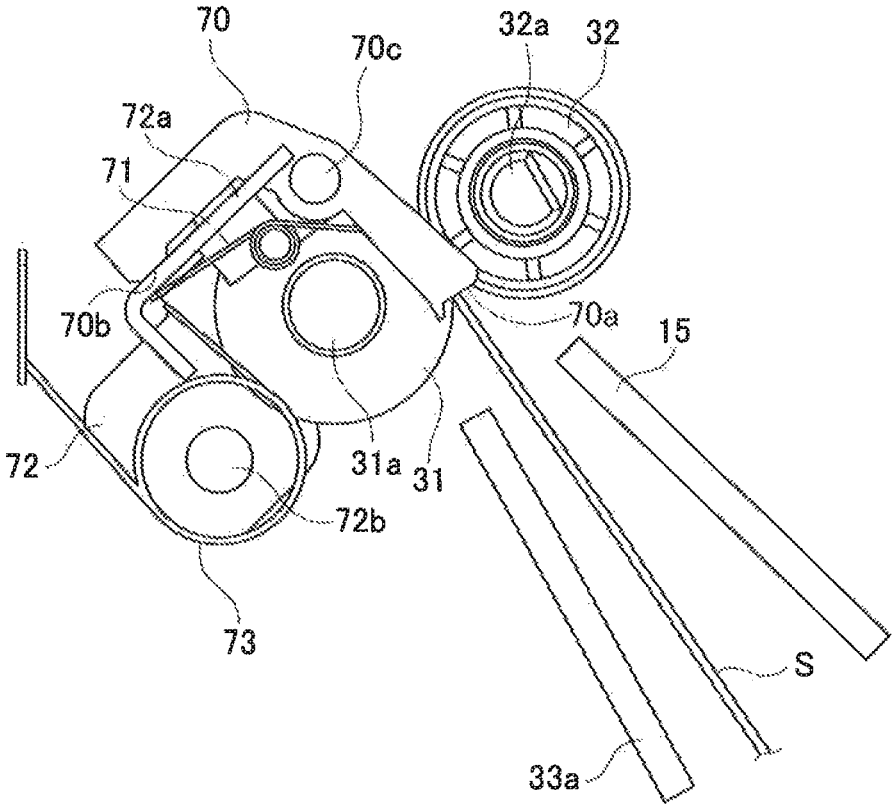
FIG. 5 is a sectional view illustrating a state in which a leading edge of the sheet abuts against an abutment surface of a locking member located in a protruding position.
Figure 6:
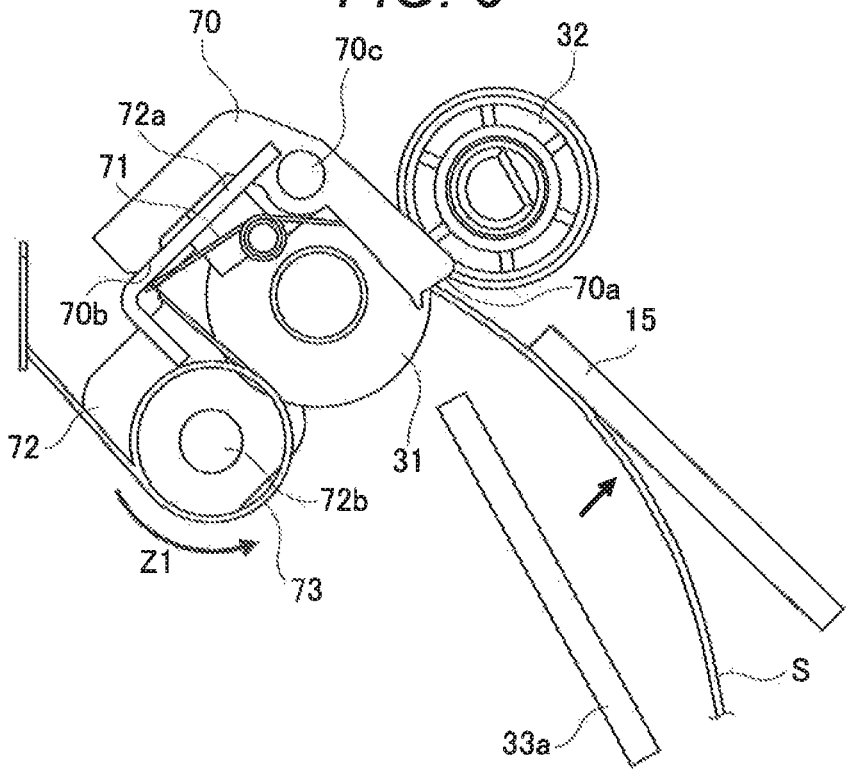
FIG. 6 is a sectional view illustrating a state in which the leading edge of the sheet strikes against the abutment surface of the locking member and the sheet is curved.
Figure 7:
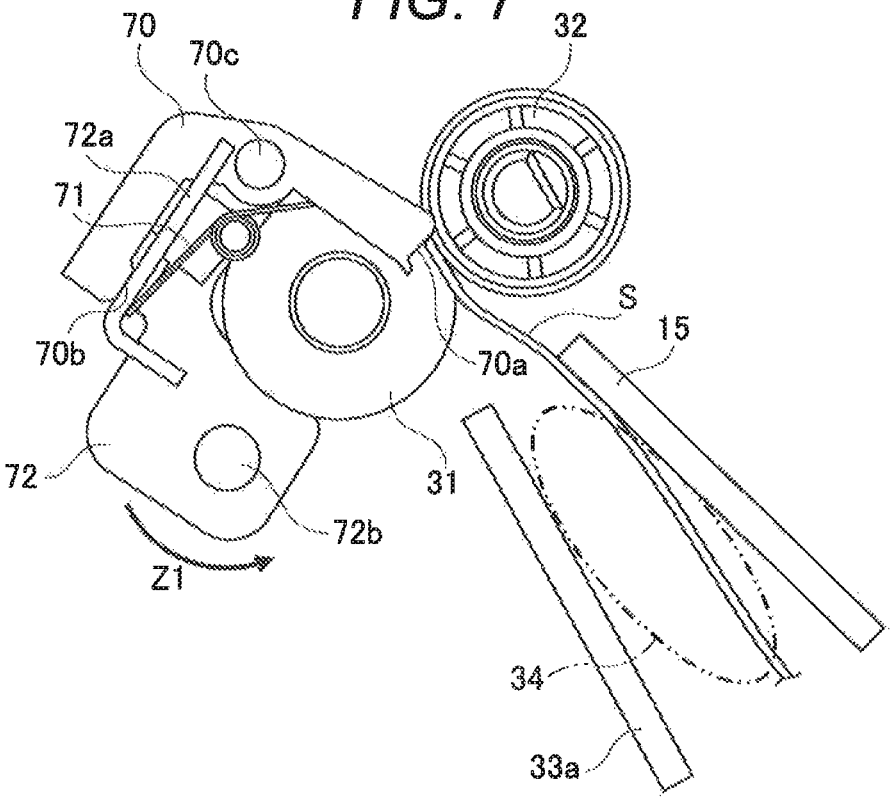
FIG. 7 is a sectional view illustrating a state in which the abutment surface is pushed by the curved sheet so that a holding member configured to hold the locking member is rotated.
Figure 9:
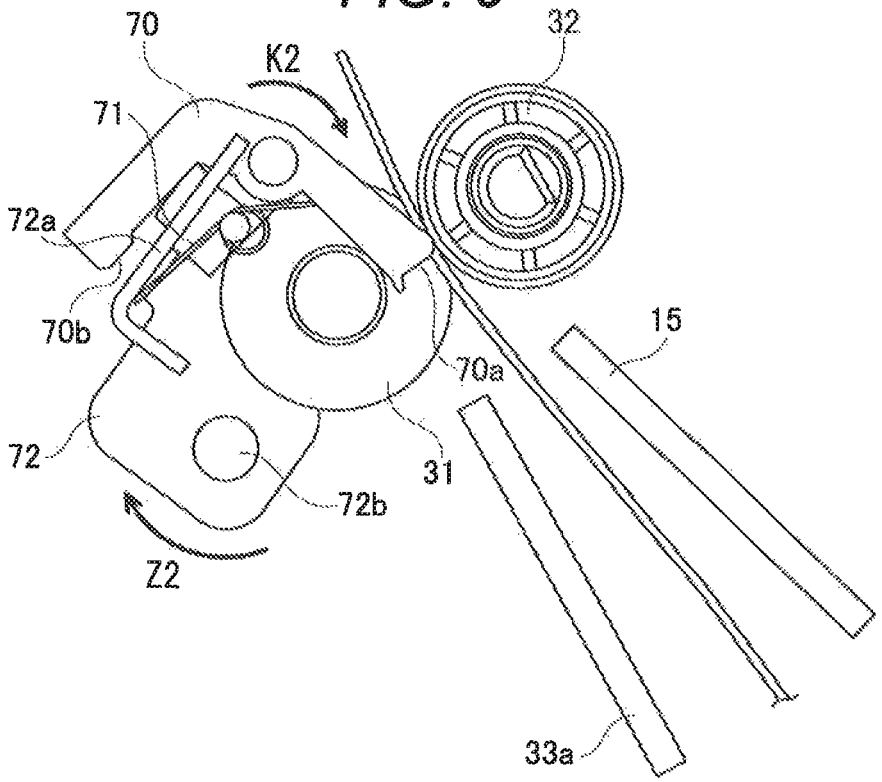
FIG. 9 is a sectional view illustrating a state in which the locking member is moved to a retracted position while being held in contact with a surface of the sheet disengaged from the abutment surface.
Figure 10:
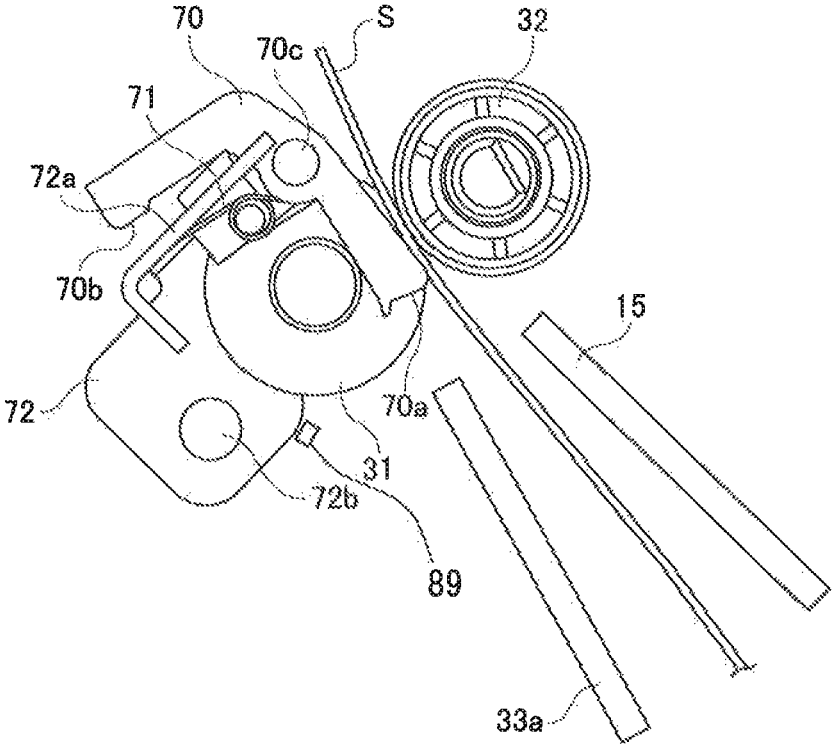
FIG. 10 is a sectional view illustrating a state in which the sheet passes above the locking member retracted to the retracted position (the sheet passage position).
Figure 11:
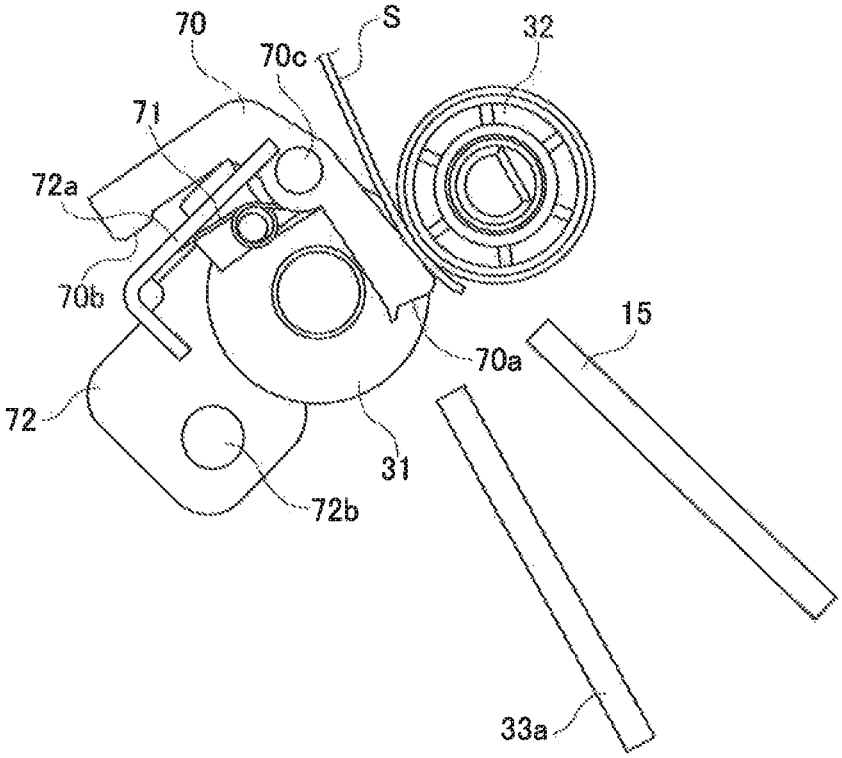
FIG. 11 is a sectional view of the locking member immediately before the sheet passes through a nip.
Figure 12:
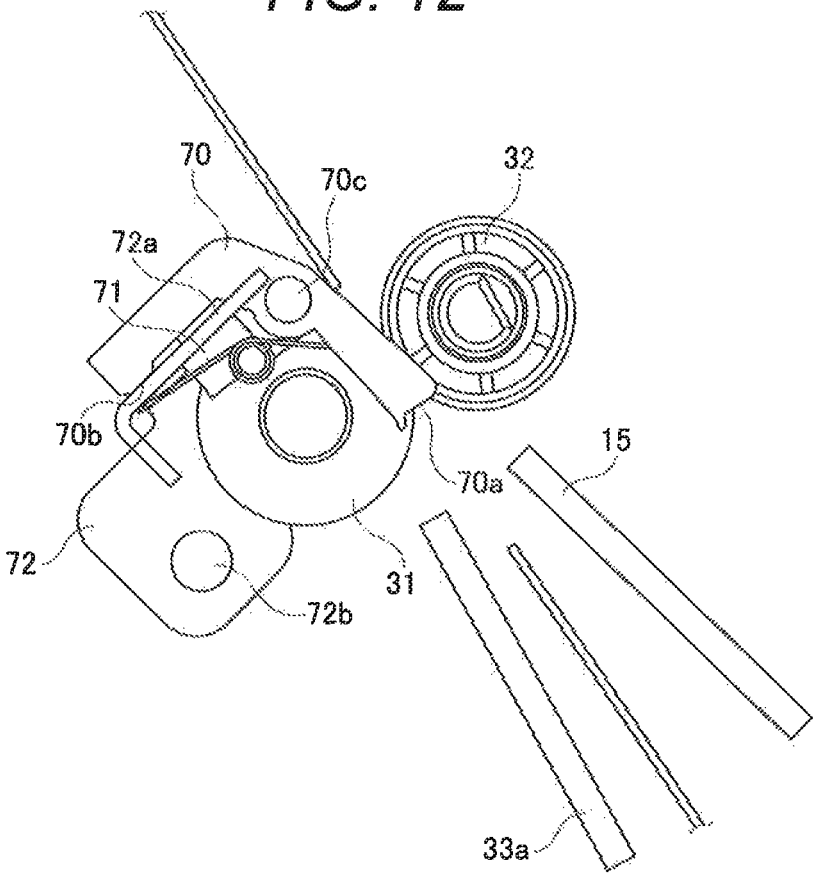
FIG. 12 is a sectional view illustrating a state in which the locking member is returned to the protruding position after the sheet passes through the nip.
Figure 13:
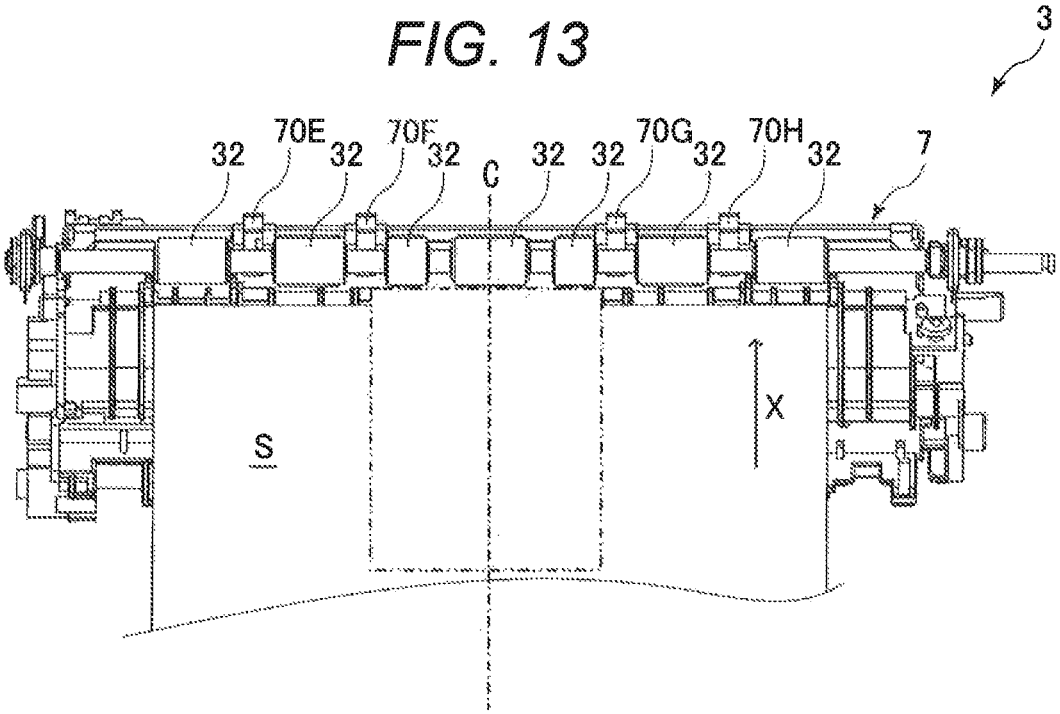
FIG. 13 is a view illustrating a state in which a sheet having a different sheet width is conveyed.

Next, how the skew feed correction of the sheet S is performed by the skew feed correcting portion 7 according to the first embodiment will be described with reference to FIGS. 4 to 13 in addition to FIG. 3. FIG. 4 is a plan view illustrating a state in which the sheet S enters the sheet conveying portion 3 in a skewed state of the sheet S. FIG. 5 is a sectional view illustrating a state in which the leading edge of the sheet S abuts against the abutment surface 70*a* of the locking member 70 located at the protruding position. FIG. 6 is a sectional view illustrating a state in which the leading edge of the sheet S strikes against the abutment surface 70*a* of the locking member 70 and the sheet S is curved. FIG. 7 is a sectional view illustrating a state in which the abutment surface 70*a* is pushed by the curved sheet S so that the holding member 72 configured to hold the locking member 70 is rotated. FIG. 8 is a sectional view illustrating a state in which the leading edge of the sheet S is disengaged from the abutment surface 70*a* and the locking member 70 is rotated by a repulsive force received from the sheet S. FIG. 9 is a sectional view illustrating a state in which the locking member 70 is moved to the retracted position while being held in contact with the surface of the sheet S disengaged from the abutment surface 70*a*. FIG. 10 is a sectional view illustrating a state in which the sheet S passes above the locking member 70 retracted to the retracted position (sheet passage position). FIG. 11 is a sectional view of the locking member 70 immediately before the sheet S passes through the nip N. FIG. 12 is a sectional view illustrating a state in which the locking member 70 is returned to the protruding position after the sheet S passes through the nip N. FIG. 13 is a view illustrating a state in which a sheet S having a different sheet width is conveyed.

As illustrated in FIG. 4, for example, when the sheet S fed from the sheet feeding portion 2 enters the sheet conveying portion 3 in a skewed state with respect to the sheet conveying direction X, without provision of the skew feed correcting portion 7, the sheet S is conveyed to the image forming portion 4 on the downstream side in the skewed posture of the sheet S as it is. When the sheet S is conveyed to the image forming portion 4 in the skewed posture as it is, the image to be transferred onto the sheet S is recorded in a tilted state with respect to the sheet S. As a result, recording accuracy is deteriorated. However, in this embodiment, the skew feed correcting portion 7 is arranged in the sheet conveying portion 3, and hence the sheet S can be conveyed while being subjected to skew feed correction. As a result, deterioration in recording accuracy can be prevented. In the following, an operation of the skew feed correcting portion 7 will be described in detail.

First, as illustrated in FIG. 3, before the sheet S enters the sheet conveying portion 3, the holding member 72 is located at the first position by an urging force of the first urging spring 73. Then, the locking member 70, which is held by the holding member 72 located at the first position, is urged by the second urging spring 71 so that the striking surface 70*b* strikes against the regulating portion 72*a*. With this, the locking member 70 comes to the protruding position. In this way, the abutment surface 70*a* of the locking member 70 is located on the sheet conveying path. In the following, this position in a state in which the holding member 72 is located at the first position while the locking member 70 is located at the protruding position is referred to as "home position" as a waiting position.

When the sheet S enters the sheet conveying portion 3 in the skewed state of the sheet S with respect to the sheet conveying direction X, first, a preceding leading edge of the sheet S abuts against the abutment surface 70*a* of one of the plurality of locking members 70 (for example, locking member 70H illustrated in FIG. 4). In this state, the holding member 72 and the locking members 70 remain at the home position without being rotated, and the sheet S is locked. This is because the urging force of the first urging spring 73 is set to be larger than a conveying force for conveying the sheet S (for example, feeding force of the sheet feeding portion 2). Then, when the sheet feeding portion 2 further feeds the sheet S, as illustrated in FIG. 5, the portions of the leading edge of the sheet S sequentially abut against the abutment surfaces 70*a* of the plurality of locking members 70 (in the order of the locking members 70G, 70F, and 70E illustrated in FIG. 4) while the preceding portion of the leading edge of the sheet S being locked to the abutment surface 70*a* of the locking member 70H.

In this process, as illustrated in FIGS. 6 and 7, inside the loop forming portion 34 formed by the guide portion 33*a* and the guide frame 15, the sheet S forms a loop curved in an arrow direction illustrated in FIG. 6. Note that, the curved loop of the sheet S at this time is larger on the right side than on the left side illustrated in FIG. 4. A series of those movements causes the leading edge of the sheet S to be aligned with the abutment surfaces 70*a* of the plurality of locking members 70 so that the leading edge of the sheet S becomes parallel to the sheet width direction Y orthogonal to the sheet conveying direction X. In this way, skew feed of the sheet S is corrected.

When the sheet S forms a predetermined loop, a pressing force of moving the holding member 72 and the locking members 70 in a direction (rotational direction) indicated by the arrow Z1 in FIG. 6 against the urging force of the first urging spring 73 is generated by stiffness of the sheet S. With this, as illustrated in FIG. 7, the holding member 72 is rotated in the direction Z1 together with the locking members 70, and the leading edge of the sheet S is nipped by the nips N between the conveying rollers 31 and the conveying rotatable members 32 in the process of rotation of the holding member 72. Note that, when the locking members 70 are rotated together with the holding member 72 by the sheet S which presses the abutment surfaces 70*a*, the locking members 70 are rotated while being located at the protruding position. This is because the striking surface 70*b* is struck against the regulating portion 72*a* of the holding member 72, and hence the protruding position is maintained. Meanwhile, at this time, the locking members 70 are not rotated in a direction indicated by the arrow K2 (refer to FIG. 9).

In this context, skew feed correction performance of the skew feed correcting portion 7 becomes greater in proportion to a size of the loop formed inside the loop forming portion 34 formed by the guide portion 33*a* and the guide frame 15. In other words, as illustrated in FIG. 7, it is desired that a larger space be secured for the loop forming portion 34. Further, the predetermined loop refers to a loop which is formed in the sheet S inside the loop forming portion 34 and increases apparent stiffness of the sheet S by the part of the loop abutting against the guide frame 15 so that the holding member 72 and the locking members 70 are rotated. When the sheet S forms such a loop inside the loop forming portion 34, the loop partially abuts against the guide frame 15. As a result, the apparent stiffness of the sheet S becomes higher, and hence the holding member 72 and the locking members 70 can be rotated.

Figure 8:
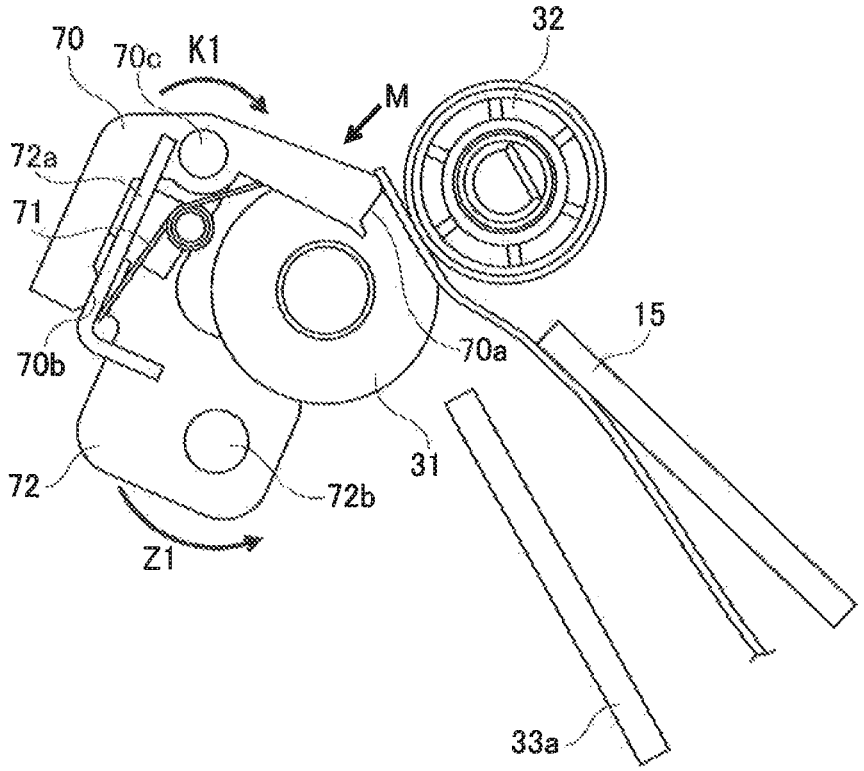
FIG. 8 is a sectional view illustrating a state in which the leading edge of the sheet is disengaged from the abutment surface and the locking member is rotated by a repulsive force received from the sheet.

As illustrated in FIG. 8, when the holding member 72 pushed by the leading edge of the sheet S is further rotated together with the locking members 70 and reaches the second position, the abutment surfaces 70*a* of the locking members 70 held by the holding member 72 are retracted from the sheet conveying path. When the abutment surfaces 70*a* of the locking members 70 are retracted from the sheet conveying path, the leading edge of the sheet S passes beyond top points of the abutment surfaces 70*a*. In other words, the leading edge of the sheet S is disengaged from the abutment surfaces 70*a*. When the leading edge of the sheet S is disengaged from the abutment surfaces 70*a*, the locking members 70 receive the repulsive force from the sheet S nipped by the nips N between the conveying rollers 31 and the conveying rotatable members 32 in a direction (direction to the retracted position) indicated by the arrow M in FIG. 8. After the locking members 70 receive the repulsive force from the sheet S in the direction indicated by the arrow M, as illustrated in FIG. 9, the locking members 70 start to be rotated in the direction indicated by the arrow K2 against an urging force of the second urging springs 71, in other words, start to move to the retracted position. Note that, the second urging springs 71 are configured to urge the locking members 70 in the direction indicated by the arrow K1 with a force smaller than a moment of the repulsive force of the sheet S. By receiving the repulsive force of the sheet S, the locking members 70 are rotated in the direction indicated by the arrow K2.

Further, in accordance with elimination of the pressing force from the sheet S, the holding member 72 starts to be rotated in the direction indicated by the arrow Z2 in FIG. 9 toward the first position by the urging force of the first urging spring 73. In accordance with the movement of the holding member 72 in the direction indicated by the arrow Z2, the locking members 70 are moved further to the retracted position while contacting the surface of the sheet S. Then, as illustrated in FIG. 10, when the holding member 72 returns to the first position at which the holding member 72 abuts against the stopper 89, the locking members 70 are regulated from moving to the protruding position (moving to the surface side) by the sheet S being in the process of passing through the sheet conveying path, and wait at the retracted position while being held in contact with the surface of the sheet S. In FIG. 10 in which the holding member 72 is located at the first position, the abutment surfaces 70*a* of the locking members 70, which are in contact with the surface of the sheet S, are located on the upstream side with respect to a nip of the registration roller pair 11. After the sheet S passes through the sheet feeding portion 2, the stiffness of the sheet S decreases. In accordance therewith, as illustrated in FIG. 11, the locking members 70 gradually return to the protruding position (home position). Further, after a trailing edge of the sheet S passes through the sheet conveying path (has gone past the nips N between the conveying rollers 31 and the conveying rotatable members 32), as illustrated in FIG. 12, the locking members 70 are returned to the protruding position by the urging force of the second urging springs 71, and the abutment surfaces 70*a* return to the positions on the sheet conveying path. In other words, the abutment surfaces 70*a* enter a state of waiting at the home position for correcting skew feed of a succeeding sheet. In this way, by repeating the series of operations described above with reference to FIGS. 5 to 12, skew feed of the sheets S sequentially fed from the sheet feeding portion 2 can be sequentially corrected.

As described above, in the image forming apparatus 1 according to the first embodiment, the sheet S is brought into abutment against the abutment surfaces 70*a* of the locking members 70 so that skew feed of the sheet S is corrected. Then, the holding member 72 moves to the second position together with the locking members 70. After that, when the leading edge of the sheet S is disengaged from the abutment surfaces 70*a* at the second position, the holding member 72 returns to the first position and the locking members 70 wait at the retracted position until the sheet S has gone past the nips N. Thus, immediately after the sheet S passes through (has gone past) the nips N, the locking members 70 can be returned to the protruding position at which the leading edge of the succeeding sheet S can be brought into abutment against the abutment surfaces 70*a*, and the skew feed correcting portion 7 can be returned to the home position. With this, a time period between a time when the sheet S passes through (has gone past) the nips N and a time when the locking members 70 return to the home position can be reduced. As a result, a sheet-to-sheet distance is prevented from increasing even at a higher sheet conveying speed, and hence higher throughput can be obtained.

Further, when the width of the sheet S is relatively large (sheet S indicated by the solid line in FIG. 13), two locking members 70E and 70H arranged to correspond mainly to vicinities of both end portions of the sheet S act on the leading edge of the sheet S to correct a skew feed of the sheet S. Meanwhile, when the width of the sheet S to be used is relatively small to an extent of not reaching the locking member 70E or 70H (sheet S indicated by the double-dotted line in FIG. 13), locking members 70F and 70G arranged closer to a central portion than the locking members 70E and 70H correct a skew feed of the sheet S. The image forming apparatus 1 includes the locking members 70F and 70G so that contact pressure exerted on the abutment surfaces 70*a* of the locking members 70, which abut against the leading edge of the sheet S, can be reduced and that local imprints to be generated by contact of the leading edge of the sheet S having a relatively large width with the locking members 70 can be prevented.

Further, in order to obtain skew feed correction performance which enables more accurate correction of the skew feed of the sheet S, it is preferred that the plurality of locking members 70 corresponding to various widths of the sheets S be arranged at as large intervals as possible and substantially symmetrically with respect to a center of the width of the sheet S. This is because the purpose of reducing correction angle errors of the leading edge of the sheet S with respect to a direction of the rotary shafts of the conveying rollers 31 and the conveying rotatable members 32. Thus, the locking members 70 are arranged in the vicinities of both the end portions of the sheet S to be conveyed. However, it is preferred to arrange the locking member 70 also in a vicinity of a conveying central portion C of the sheet S so that the sheet S having a relatively small width is also subjected to skew feed correction.

Further, at this time, it is preferred to set an interval between the two locking members 70F and 70G on both sides near the conveying central portion C of the sheet conveying path of the sheet S to be smaller than a minimum width of the sheet S. In that case, it is preferred to arrange the abutment surfaces 70*a* of the locking members 70F and 70G, which abut against the leading edge of the sheet S, slightly more downstream in the sheet conveying direction than the abutment surfaces 70*a* of the locking members 70E and 70H. With this, even when correcting skew feed of the sheet S having a large width, none of the locking members 70F and 70G abuts against the leading edge of the sheet S. Thus, the correction angle errors can be reduced.

Further, a distance between the abutment surfaces 70*a* and the nips N between the conveying rollers 31 and the conveying rotatable members 32 is reduced. With this, the sheet S is conveyed while being nipped by the nips N between the conveying rollers 31 and the conveying rotatable members 32 immediately after the locking members 70 correct a skew feed of the sheet S. Thus, an effect of the skew feed correction of the sheet S can be maintained. Further, the plurality of abutment surfaces 70*a* of the locking members 70, which abut against the leading edge of the sheet S, are provided substantially symmetrically with respect to the center of the sheet width in the sheet width direction Y orthogonal to the sheet conveying direction X. With this, it is possible to obtain higher skew feed correction performance which enables more accurate skew feed correction of the sheet S. Further, local imprints can be prevented from being formed even through abutment of the sheet S against the locking members 70.

Figure 14:
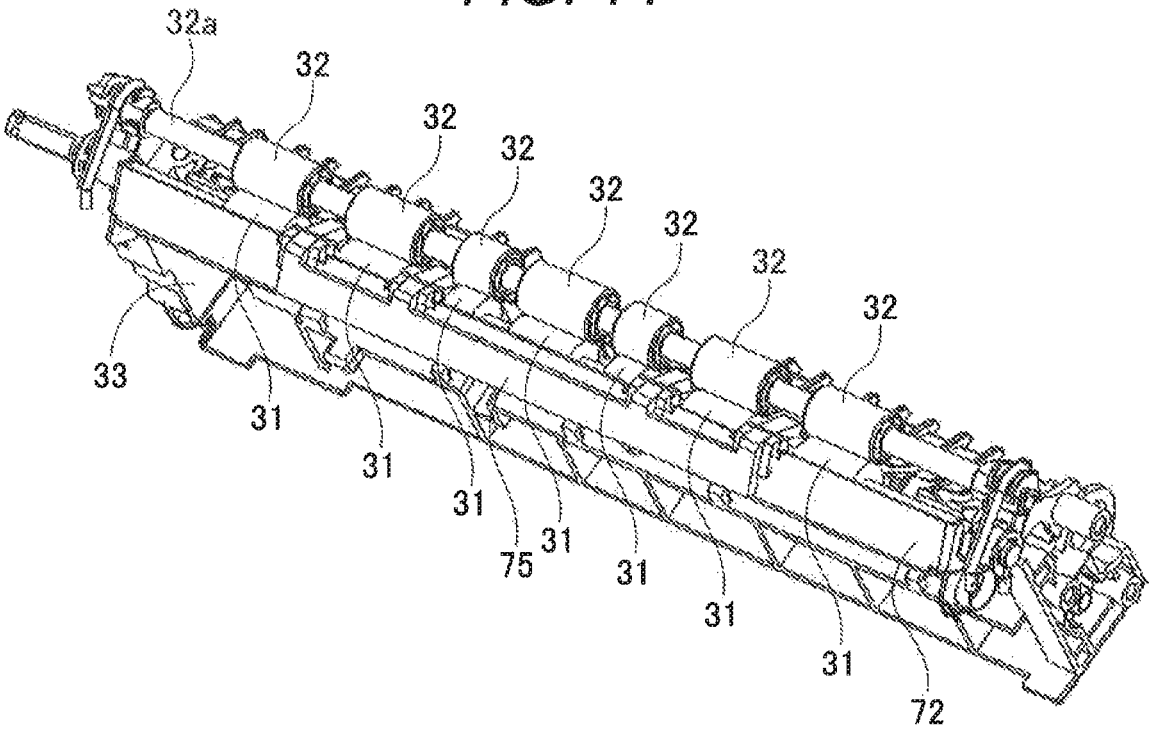
FIG. 14 is a perspective view of a sheet conveying portion according to a modification of the first embodiment.

Note that, as illustrated in FIG. 14, for example, respective rear surface sides of the plurality of locking members 70 of the sheet conveying portion 3 may be connected to each other with a connecting portion 75.

Second Embodiment

Next, an image forming apparatus 1A according to a second embodiment of the present invention will be described with reference to FIGS. 15 to 18 as well as FIG. 1. The image forming apparatus 1A according to the second embodiment is different from the image forming apparatus 1 according to the first embodiment in that the locking members 70 are moved by being pressed against a pressing portion 16 as a pressing member when the holding member 72 is rotated to the second position. Thus, in the second embodiment, differences from the first embodiment, specifically, the structure configured to rotate the locking members 70 will be mainly described. Thus, the same components as those of the image forming apparatus 1 according to the first embodiment are denoted by the same reference symbols, and the descriptions thereof are omitted herein.

Figure 15:
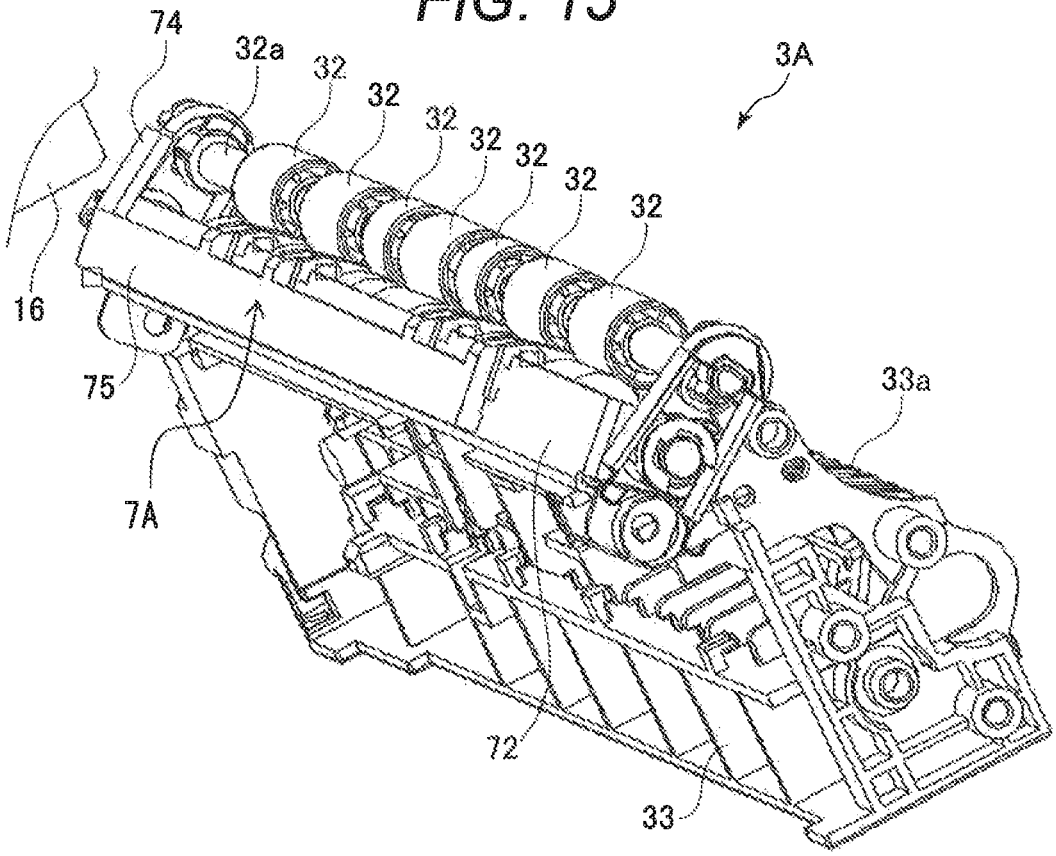
FIG. 15 is a perspective view of a sheet conveying portion according to a second embodiment of the present invention.

First, an overall structure of the image forming apparatus 1A according to the second embodiment will be described with reference to FIG. 15 as well as FIG. 1. FIG. 15 is a perspective view of a sheet conveying portion 3A according to the second embodiment.

As illustrated in FIG. 1, the image forming apparatus 1A according to the second embodiment includes the sheet feeding portion 2, the sheet conveying portion 3A, the image forming portion 4, the fixing portion 5, the delivery portion 6, and the pressing portion 16 provided on a main body of the image forming apparatus 1A. As illustrated in FIG. 15, the sheet conveying portion 3A includes the plurality of conveying rollers 31, the plurality of conveying rotatable members 32, the feeding frame 33, and a skew feed correcting portion 7A. The skew feed correcting portion 7A includes the holding member 72, the first urging spring 73, the plurality of locking members 70, the plurality of second urging springs 71, a pressed portion 74 configured to abut against the pressing portion 16, and the connecting portion 75. The connecting portion 75 connects the plurality of locking members 70 to each other on the rear surfaces sides of the plurality of locking members 70. The pressed portion 74 is connected to the connecting portion 75.

Figure 16:
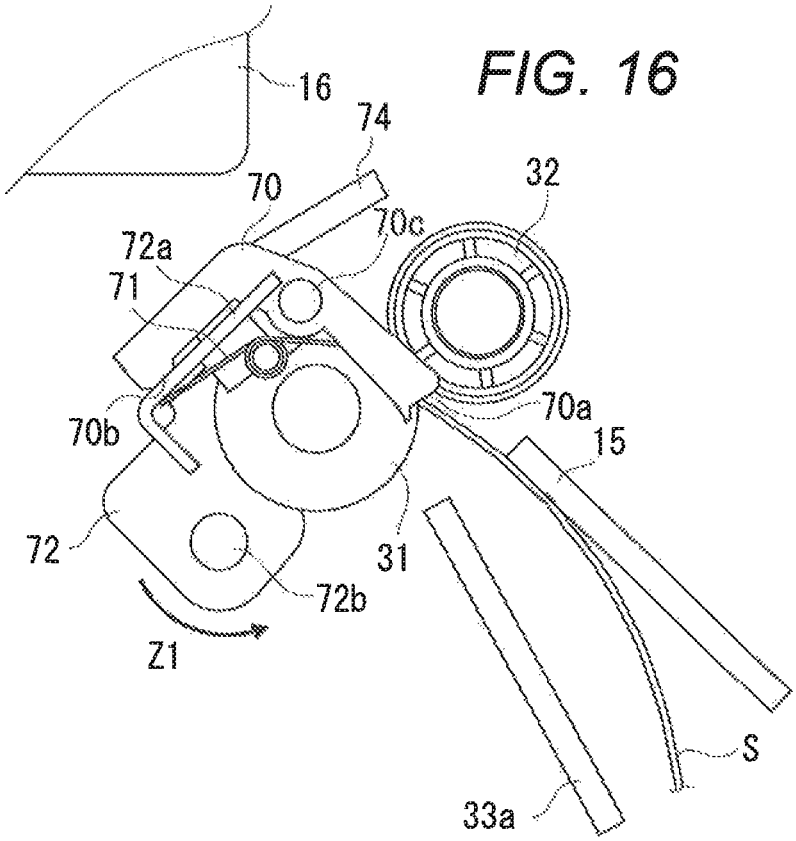
FIG. 16 is a sectional view illustrating a state in which the leading edge of the sheet abuts against the abutment surface of the locking member and the sheet is curved.
Figure 17:
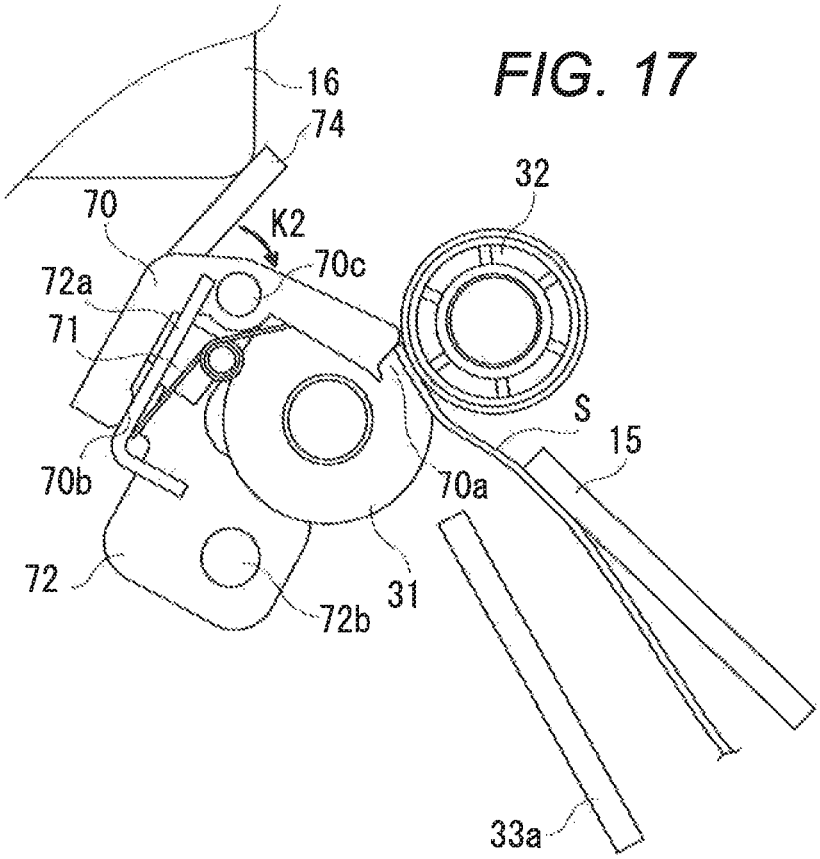
FIG. 17 is a sectional view illustrating a state in which the abutment surface is pushed by the curved sheet and the holding member configured to hold the locking member is rotated so that the pressed portion abuts against a pressing portion.
Figure 18:
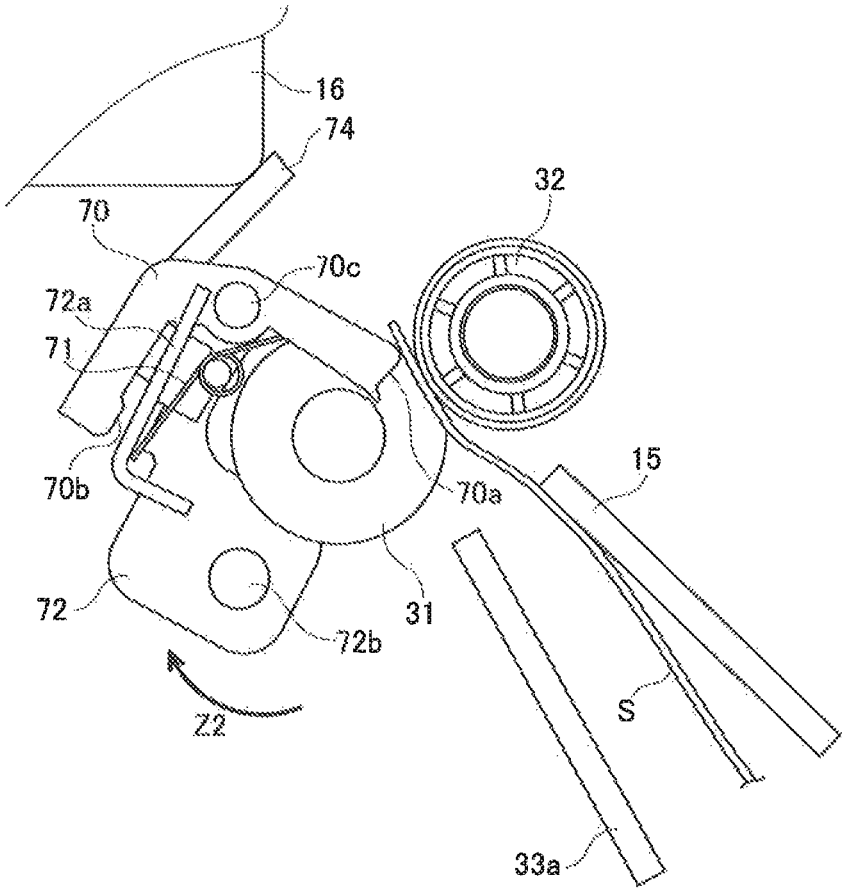
FIG. 18 is a view illustrating a state in which the leading edge of the sheet is disengaged from the abutment surface and the locking member is rotated by a pressing force received from the pressing portion.

Next, how the skew feed correcting portion 7A of the sheet conveying portion 3A of the image forming apparatus 1A according to the second embodiment corrects skew feed of the sheet S will be described with reference to FIGS. 16 to 18. FIG. 16 is a sectional view illustrating a state in which the leading edge of the sheet S abuts against the abutment surfaces 70*a* of the locking members 70 and the sheet S is curved. FIG. 17 is a sectional view illustrating a state in which the abutment surfaces 70*a* are pushed by the curved sheet S and the holding member 72 configured to hold the locking members 70 is rotated so that the pressed portion 74 abuts against the pressing portion 16. FIG. 18 is a view illustrating a state in which the leading edge of the sheet S is disengaged from the abutment surfaces 70*a* and the locking members 70 are rotated by a pressing force received from the pressing portion 16.

As illustrated in FIG. 16, when the holding member 72 and the locking members 70 are located at the home position, the pressed portion 74 is located out of contact with the pressing portion 16. In this state, when the sheet S enters the sheet conveying portion 3A and the leading edge of the sheet S abuts against the abutment surfaces 70*a* of the locking members 70, the sheet S is curved to form a loop. With this, the holding member 72 is pushed by the sheet S so as to be rotated to the second position together with the locking members 70.

As illustrated in FIG. 17, when the holding member 72 configured to hold the locking members 70 located at the protruding position is rotated to the second position, the pressed portion 74 abuts against the pressing portion 16. In accordance therewith, the locking members 70 located at the protruding position are pressed toward the retracted position. At this time, the holding member 72 reaches the second position, and the abutment surfaces 70*a* of the locking members 70 held by the holding member 72 are retracted from the sheet conveying path. As a result, the leading edge of the sheet S is disengaged from the abutment surfaces 70*a*. Thus, when the locking members 70 are pushed toward the retracted position, as illustrated in FIG. 18, the locking members 70 can be moved without hindering conveyance of the sheet S. Further, at this time, even in a case where the leading edge of the sheet S remains in abutment against the abutment surfaces 70*a*, when the locking members 70 are rotated toward the retracted position, the leading edge of the sheet S can be disengaged from the abutment surfaces 70*a* by the stiffness of the sheet S.

As described above, the image forming apparatus 1A according to the second embodiment includes the pressing portion 16 and the pressed portion 74. With this, when the locking members 70 are moved to the second position together with the holding member 72, the locking members 70 can be reliably rotated toward the retracted position.

Third Embodiment

Next, an image forming apparatus 1B according to a third embodiment of the present invention will be described with reference to FIGS. 19 to 22B as well as FIG. 1. The image forming apparatus 1B according to the third embodiment is different from the image forming apparatus 1 according to the first embodiment in that a leading edge detecting portion configured to detect the leading edge of the sheet S is provided to the skew feed correcting portion 7B. Thus, in the third embodiment, differences from the first embodiment, specifically, the leading edge detecting portion will be mainly described. Thus, the same components as those of the image forming apparatus 1 according to the first embodiment are denoted by the same reference symbols, and the descriptions thereof are omitted herein.

Figure 19:
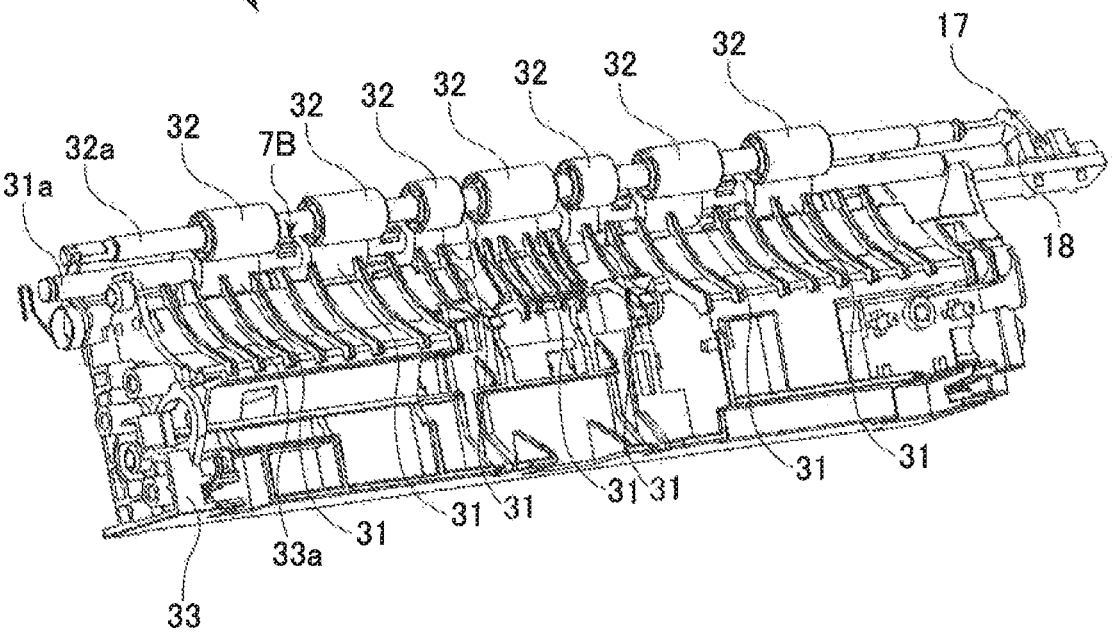
FIG. 19 is a perspective view of a sheet conveying portion according to a third embodiment.

First, an overall structure of the image forming apparatus 1B according to the third embodiment will be described with reference to FIG. 19 as well as FIG. 1. FIG. 19 is a perspective view of a sheet conveying portion 3B according to the third embodiment.

As illustrated in FIG. 1, the image forming apparatus 1B according to the third embodiment includes the sheet feeding portion 2, the sheet conveying portion 3B, the image forming portion 4, the fixing portion 5, and the delivery portion 6. As illustrated in FIG. 19, the sheet conveying portion 3B includes the plurality of conveying rollers 31, the plurality of conveying rotatable members 32, the feeding frame 33, and a skew feed correcting portion 7B. The skew feed correcting portion 7B includes the holding member 72, the first urging spring 73, the plurality of locking members 70, the plurality of second urging springs 71, a detection lever 17 as a sheet detecting member, and a detecting sensor 18. The detection lever 17 and the detecting sensor 18 form the leading edge detecting portion.

The detection lever 17 is connected coaxially to the rotary shaft 70*c* of the locking members 70, and moved in conjunction with the movement of the locking members 70. The detecting sensor 18 is an optical sensor (for example, photo sensor) forming an optical path with a light emitting element and a light receiving element, and is fixed to the feeding frame 33. The optical path of the detecting sensor 18 is blocked with the detection lever 17 when the holding member 72 and the locking members 70 are in the home position. The detecting sensor 18 produces a detection signal when blocking of the optical path with the detection lever 17 is cancelled. In other words, when the holding member 72 is moved to the second position together with the locking members 70, the leading edge of the sheet S is detected, and in response thereto, the detecting sensor 18 produces a detection signal.

Figure 20A:
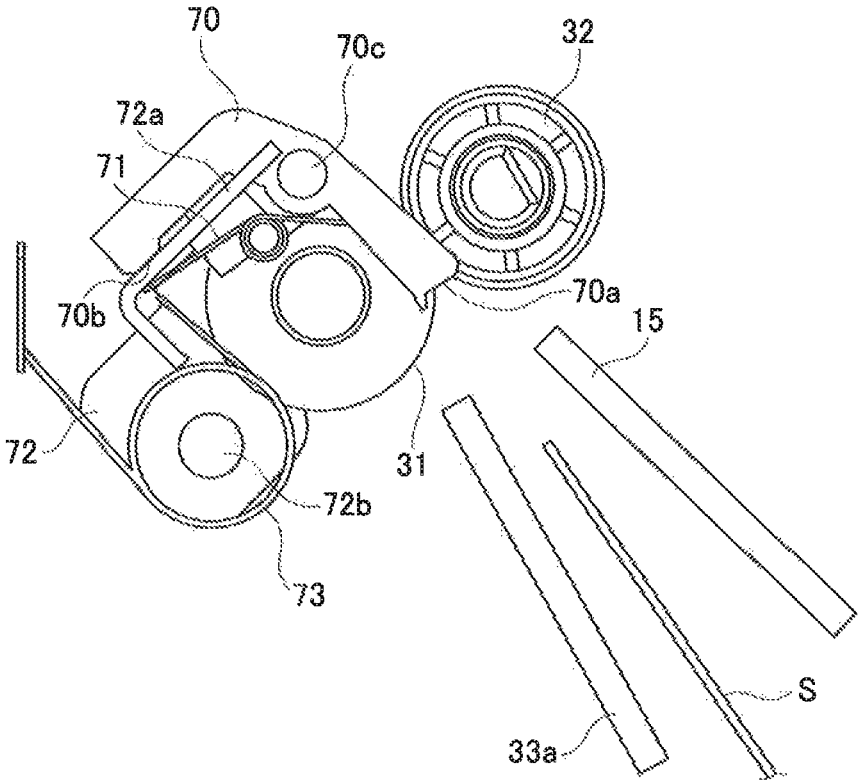
FIG. 20A is a view illustrating a state in which a sheet enters the sheet conveying portion according to the third embodiment.
Figure 20B:
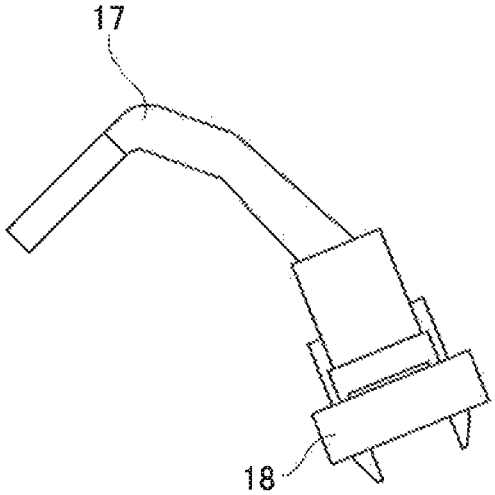
FIG. 20B is a view illustrating a blocked state in which an optical path of a detecting sensor is blocked by a detecting lever.
Figure 21A:
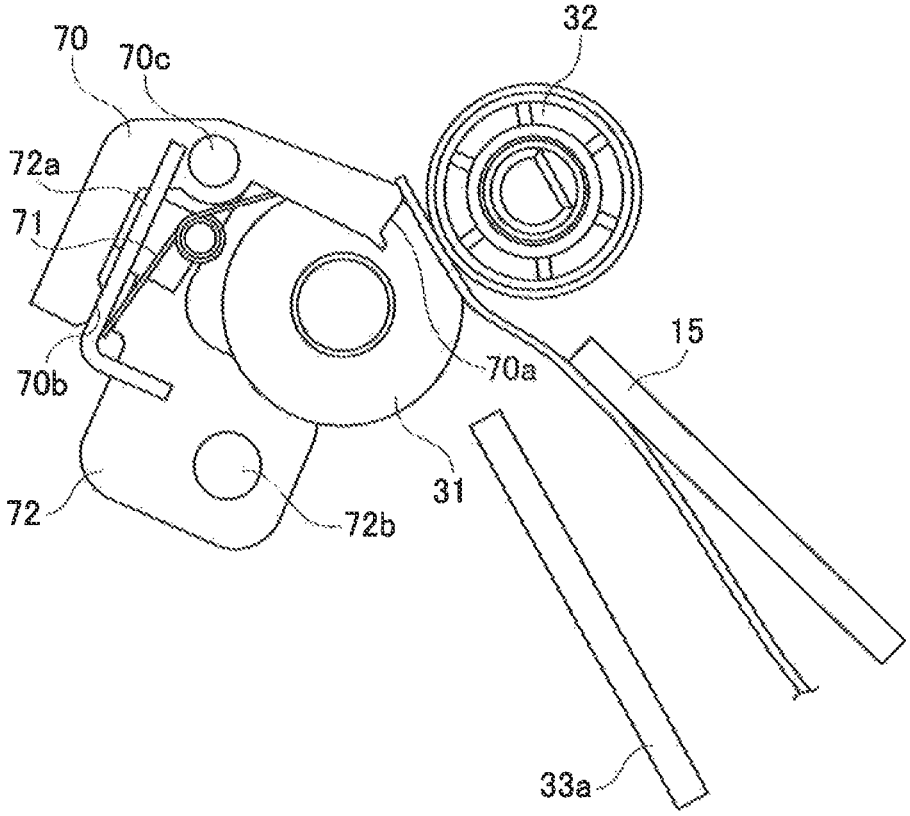
FIG. 21A is a view illustrating a state in which the holding member is moved to a second position and the leading edge of the sheet is disengaged from the abutment surface.
Figure 21B:
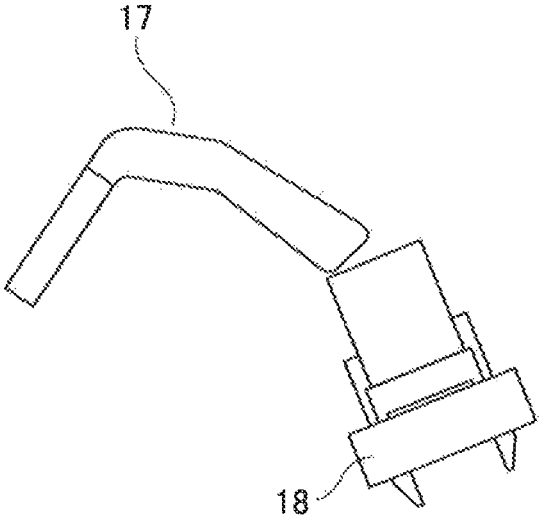
FIG. 21B is a view illustrating a state in which the detecting lever is separated from the optical path of the detecting sensor.
Figure 22A:
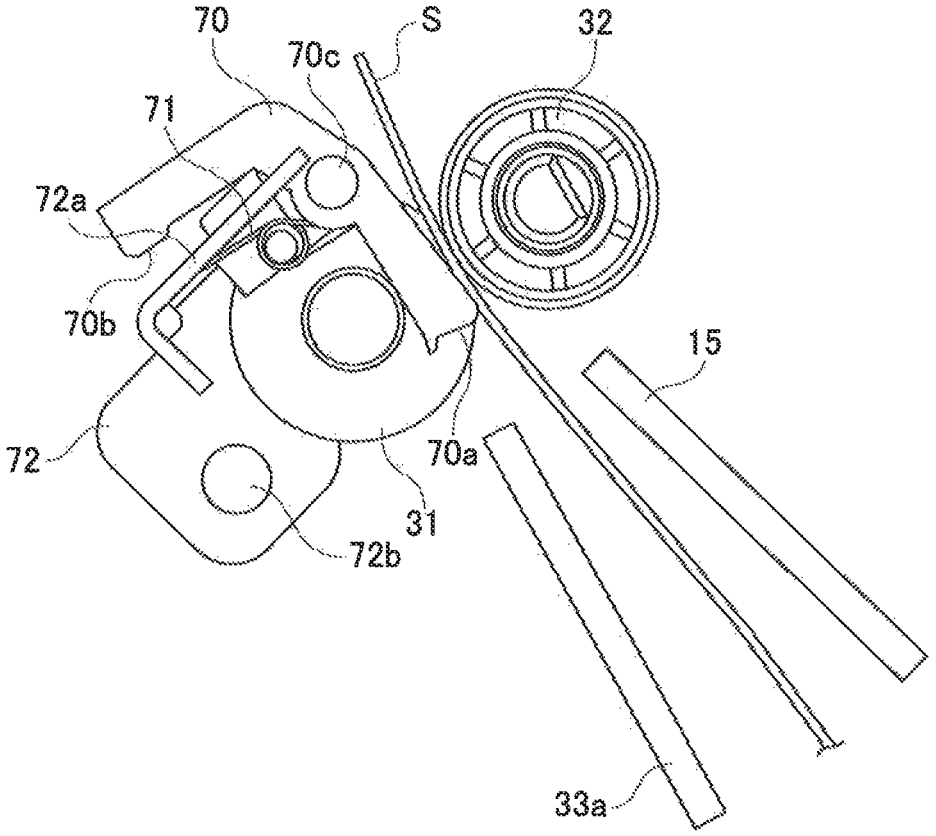
FIG. 22A is a sectional view illustrating a state in which the sheet passes the locking member retracted to the retracted position.
Figure 22B:
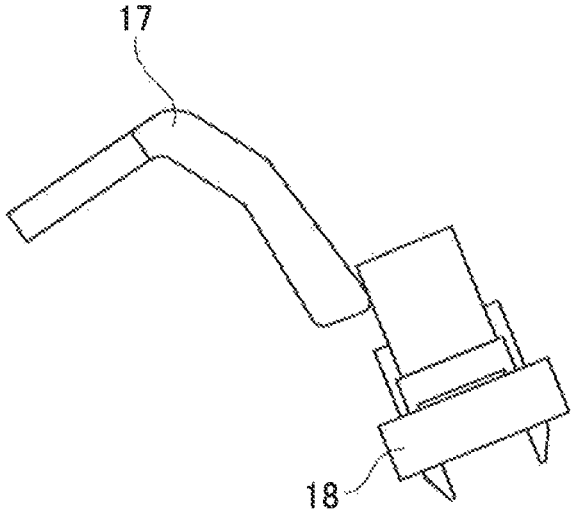
FIG. 22B is a view illustrating the state in which the detecting lever is separated from the optical path of the detecting sensor.
Figure 23A:
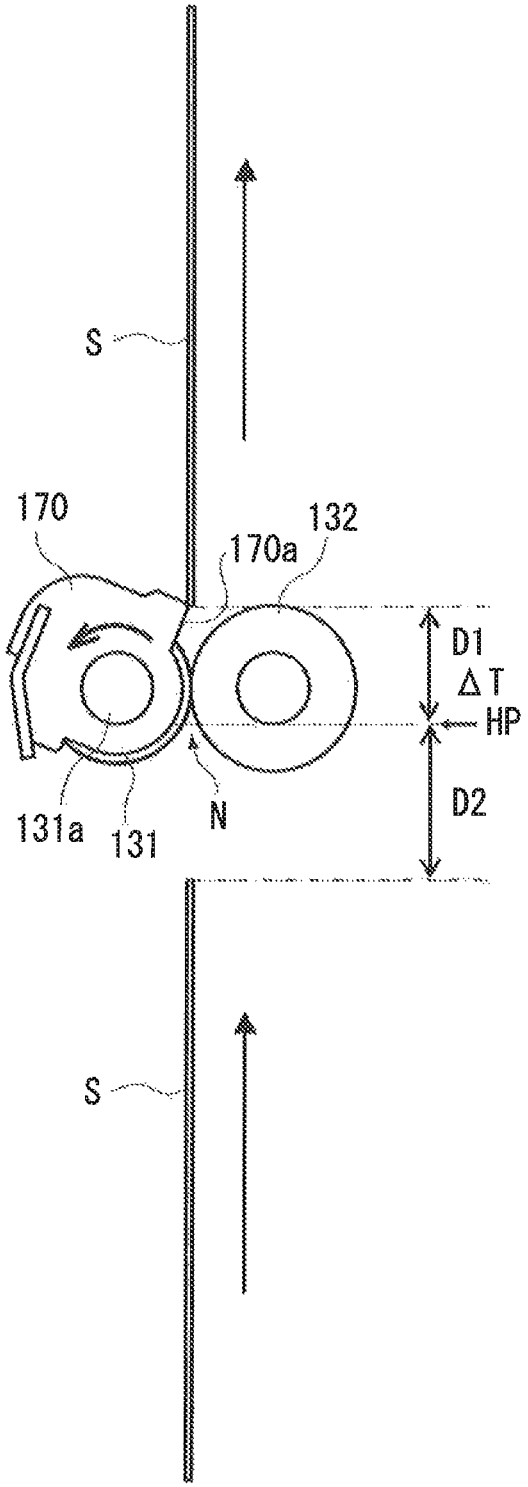
FIG. 23A is a sectional view illustrating a state in which the sheet passes through a nip by rotation of a locking member in a conventional sheet conveying apparatus.
Figure 23B:
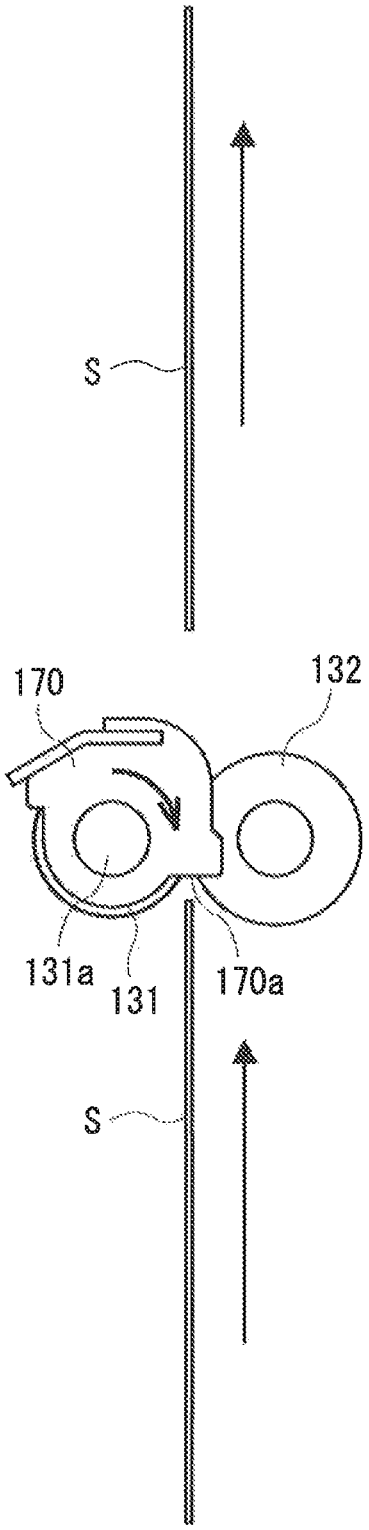
FIG. 23B is a sectional view illustrating a state in which the locking member is reversely rotated to return to a home position after the sheet has gone past the nip.

Next, how the skew feed correcting portion 7B of the sheet conveying portion 3B of the image forming apparatus 1B according to the third embodiment corrects skew feed of the sheet S will be described with reference to FIGS. 20A, 20B, 21A, 21B, 22A, and 22B. FIG. 20A is a view illustrating a state in which the sheet S enters the sheet conveying portion 3B according to the third embodiment. FIG. 21A is a view illustrating a state in which the holding member 72 is moved to the second position and the leading edge of the sheet S is disengaged from the abutment surfaces 70*a*. FIG. 22A is a sectional view illustrating a state in which the sheet S passes over the locking members 70 retracted to the retracted position. Note that, FIGS. 20A, 21A, and 22A are views each illustrating a state of the locking members 70 and the holding member 72. FIGS. 20B, 21B, and 22B are views each illustrating a state of the leading edge detecting portion.

When the holding member 72 and the locking members 70 are located in the home position as illustrated in FIG. 20A, the leading edge detecting portion is in a blocked state in which the optical path of the detecting sensor 18 is blocked by the detection lever 17 as illustrated in FIG. 20B. Next, when the holding member 72 is moved to the second position together with the locking members 70 as illustrated in FIG. 21A, the detection lever 17 interlocks with the locking members 70 as illustrated in FIG. 21B and is separated from the optical path of the detecting sensor 18. With this, the blocking of the optical path of the detecting sensor 18 with the detection lever 17 is cancelled, and in response thereto, the sheet S is detected to have reached a desired position. Then, the detecting sensor 18 produces a detection signal.

When the detection signal produced by the detecting sensor 18 is received, the image forming portion 4 starts an operation of forming an image to be transferred onto the conveyed sheet S. After that, the same operation as that in the first embodiment is performed, and as illustrated in FIG. 22A, the locking members 70 are retracted to the retracted position while the holding member 72 is located in the first position, and wait until the sheet S passes through the nips N. As illustrated in FIG. 22B, during the waiting, the detection lever 17 is separated from the optical path of the detecting sensor 18. Then, the locking members 70 return to the protruding position in accordance with completion of the passage of the sheet S through the nips N. As a result, the detection lever 17 blocks the optical path of the detecting sensor 18, and the detecting sensor 18 stops producing the detection signal.

As described above, the image forming apparatus 1B according to the third embodiment includes the detection lever 17 which interlocks with the locking members 70, and the detecting sensor 18. With this, in addition to skew feed correction of the sheet S with the locking members 70 and the holding member 72, the position of the leading edge of the sheet S can be detected. Specifically, the leading edge of the sheet S subjected to skew feed correction at the sheet conveying portion 3B is detected, and hence image formation can be performed by the image forming portion 4 at an appropriate timing based on the position of the sheet S. As a result, for example, it is no longer necessary to additionally provide a leading edge detecting portion configured to detect the position of the leading edge of the sheet S, and hence manufacturing cost can be suppressed.

Further, the detection lever 17 moves in the same way as that of the locking members 70. Thus, substantially simultaneously with completion of the passage of the trailing edge of the sheet S through the sheet conveying path, the detection lever 17 can come to and wait at the home position at which the leading edge of the succeeding sheet S is detected (position at which the optical path of the detecting sensor 18 is blocked). With this, even when a sheet-to-sheet distance is short under a high sheet conveying speed condition, the detection lever 17 can return to the home position so as to detect the leading edge of the succeeding sheet S. In this way, user's demands for higher throughput of the image forming apparatus can be met.

The embodiments of the present invention are described above, but the present invention is not limited to the embodiments described above. Further, the advantages described in the embodiments of the present invention are merely described as most preferred advantages to be achieved by the present invention. Thus, the advantages of the present invention are not limited to those described in the embodiments of the present invention.

For example, in the embodiments of the present invention, the locking members 70 are held by the holding member 72 so as to be rotatable between the protruding position and the retracting position. However, the present invention is not limited thereto. For example, the locking members 70 may be supported by the holding member 72 so as to pop up and down (slidably move) between the protruding position and the retracted position.

Further, as described in the embodiments of the present invention, the urging springs are used as a first urging unit and a second urging unit, but the present invention is not limited thereto. The first urging unit and the second urging unit may include elastic members configured to urge a holding member and a locking member, respectively. Further, as described in the embodiments of the present invention, the conveying rollers 31 and the conveying rotatable members 32 are used as a sheet conveying unit, but the present invention is not limited thereto. For example, the sheet conveying unit is not particularly limited as long as the sheet S can be nipped and conveyed.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application is a Divisional Application of U.S. patent application Ser. No. 15/153,904, filed May 13, 2016, and allowed on Nov. 1, 2016, which is a Divisional Application of U.S. patent application Ser. No. 14/365,746, filed on Jun. 16, 2014, and allowed on Feb. 16, 2016, which is a National Stage Entry of International Application No. PCT/JP2013/052779, filed on Jan. 31, 2013, which claims the benefit of Japanese Patent Application No. 2012-025190, filed Feb. 8, 2012, which are all hereby incorporated by reference herein in their entireties.

REFERENCE SIGNS LIST

1, 1A, 1B image forming apparatus
3, 3A, 3B sheet conveying portion (sheet conveying apparatus)
4 image forming portion
7, 7A, 7B skew feed correcting portion
16 pressing portion (pressing member)
17 detection lever (sheet detecting member)
18 detecting sensor
31 conveying roller (sheet conveying unit)
32 conveying rotatable member (sheet conveying unit)
70 locking member
70*a* abutment surface
71 second urging spring (second urging unit)
72 holding member
73 first urging spring (first urging unit)
74 pressed portion
S sheet

The invention claimed is:

1. A sheet conveying apparatus, comprising:

an abutment member having an abutment surface against which a leading edge of a sheet being conveyed abuts so as to correct a skew feed of the sheet;

a holding member movable between a first position at which the holding member is located with respect to a locating portion provided in a main body of the sheet conveying apparatus and a second position at which the holding member is retracted from the first position; and a rotary shaft configured to support the abutment member and the holding member so that the holding member and the abutment member are movable integrally with each other, wherein the abutment member is configured to rotate about the rotary shaft so as to be movable between a located state in which a striking portion provided on the abutment member strikes against a regulating portion provided on the holding member to locate the abutment member with respect to the holding member and a separated state in which the striking portion and the regulating portion are separated from each other, wherein in a state in which the holding member is located in the first position and the abutment member is in the located state, the leading edge of the sheet abuts against the abutment surface to push the abutment surface to move the holding member from the first position to the second position while the abutment member is in the located state, and thereafter, when the leading edge of the sheet separates from the abutment surface, the abutment member is moved from the located state to the separated state, and wherein the holding member moves from the second position to the first position while the abutment member is in the separated state, and thereafter, when the holding member is located in the first position, the abutment member is moved from the separated state to the located state.

2. The sheet conveying apparatus according to claim 1, wherein the leading edge of the sheet separates from the abutment surface and the abutment member is pushed by the sheet so as to be moved from the located state to the separated state so that the holding member is moved from the second position to the first position while holding the abutment member in the separated state.

3. The sheet conveying apparatus according to claim 2, wherein in a state in which the holding member is located in the first position after the holding member is moved from the second position to the first position and the abutment member is pushed by the sheet, the abutment member in the separated state is held by the holding member.

4. The sheet conveying apparatus according to claim 3, wherein after a trailing edge of the sheet passes the abutment member so that a state in which the abutment member is pushed by the sheet is released, the abutment member is moved from the separated state to the located state.

5. The sheet conveying apparatus according to claim 1, further comprising an urging portion configured to urge the holding member, wherein the holding member is moved from the first position to the second position against an urging force of the urging portion.

6. The sheet conveying apparatus according to claim 1, further comprising an urging portion configured to urge the abutment member from the separated state to the located state, wherein the abutment member is pressed by the sheet so as to be moved against an urging force of the urging portion.

7. The sheet conveying apparatus according to claim 1, wherein the abutment member is rotated about the rotary shaft so as to be moved with respect to the holding member, and the holding member is rotated about a second rotary shaft different from the rotary shaft so that the holding member is moved between the first position and the second position.

8. The sheet conveying apparatus according to claim 1, further comprising a conveying portion configured to form a nip portion to nip and convey the sheet, wherein in a state in which the holding member is located in the first position while the abutment member is in the located state, the abutment surface of the abutment member is located upstream of the nip portion with respect to a sheet conveying direction.

9. The sheet conveying apparatus according to claim 8, wherein the conveying portion comprises a conveying roller configured to receive a drive force so as to be rotated and a conveying rotatable member configured to be rotated in association with rotation of the conveying roller, and wherein the leading edge of the sheet pushes the abutment surface so that the holding member and the abutment member are moved downstream of the nip portion.

10. The sheet conveying apparatus according to claim 1, wherein the abutment member is provided in a plurality of positions in a width direction intersecting with a sheet conveying direction.

11. An image forming apparatus, comprising:

an image forming portion configured to form an image on a sheet being conveyed;

an abutment member having an abutment surface against which a leading edge of the sheet being conveyed abuts so as to correct a skew feed of the sheet;

a holding member movable between a first position at which the holding member is located with respect to a locating portion provided in a main body of the image forming apparatus and a second position at which the holding member is retracted from the first position; and a rotary shaft configured to support the abutment member and the holding member so that the holding member and the abutment member are movable integrally with each other, wherein the abutment member is configured to rotate about the rotary shaft so as to be movable between a located state in which a striking portion provided on the abutment member strikes against a regulating portion provided on the holding member to locate the abutment member with respect to the holding member and a separated state in which the striking portion and the regulating portion are separated from each other, wherein in a state in which the holding member is located in the first position and the abutment member is in the located state, the leading edge of the sheet abuts against the abutment surface to push the abutment surface to move the holding member from the first position to the second position while the abutment member is in the located state, and thereafter, when the leading edge of the sheet separates from the abutment surface, the abutment member is moved from the located state to the separated state, and wherein the holding member moves from the second position to the first position while the abutment member is in the separated state, and thereafter, when the holding member is located in the first position, the abutment member is moved from the separated state to the located state.

12. The image forming apparatus according to claim 11, wherein the leading edge of the sheet separates from the abutment surface and the abutment member is pushed by the sheet so as to be moved from the located state to the separated state so that the holding member is moved from the second position to the first position while holding the abutment member in the separated state.

13. The image forming apparatus according to claim 12, wherein in a state in which the holding member is located in the first position after the holding member is moved from the second position to the first position and the abutment member is pushed by the sheet, the abutment member in the separated state is held by the holding member.

14. The image forming apparatus according to claim 13, wherein after a trailing edge of the sheet passes the abutment member so that a state in which the abutment member is pushed by the sheet is released, the abutment member is moved from the separated state to the located state.

15. The image forming apparatus according to claim 11, further comprising an urging portion configured to urge the holding member, wherein the holding member is moved from the first position to the second position against an urging force of the urging portion.

16. The image forming apparatus according to claim 11, further comprising an urging portion configured to urge the abutment member from the separated state to the located state, wherein the abutment member is pressed by the sheet so as to be moved against an urging force of the urging portion.

17. The image forming apparatus according to claim 11, wherein the abutment member is rotated about the rotary shaft so as to be moved with respect to the holding member, and the holding member is rotated about a second rotary shaft different from the rotary shaft so that the holding member is moved between the first position and the second position.

18. The image forming apparatus according to claim 11, further comprising a conveying portion configured to form a nip portion to nip and convey the sheet, wherein in a state in which the holding member is located in the first position while the abutment member is in the located state, the abutment surface of the abutment member is located upstream of the nip portion with respect to a sheet conveying direction.

19. The image forming apparatus according to claim 18, wherein the conveying portion comprises a conveying roller configured to receive a drive force so as to be rotated and a conveying rotatable member configured to be rotated in association with rotation of the conveying roller, and wherein the leading edge of the sheet pushes the abutment surface so that the holding member and the abutment member are moved downstream of the nip portion.

20. The image forming apparatus according to claim 11, wherein the abutment member is provided in a plurality of positions in a width direction intersecting with a sheet conveying direction.

* * * * *